US007856772B1

(12) United States Patent
Culp et al.

(10) Patent No.: US 7,856,772 B1
(45) Date of Patent: Dec. 28, 2010

(54) MODULAR ASSEMBLY SYSTEM

(75) Inventors: Stephen A. Culp, Chattanooga, TN (US); Terry W. Gentle, Chattanooga, TN (US)

(73) Assignee: Smart Furniture, Inc., Chattanooga, TN (US)

( * ) Notice: Subject to any disclaimer, the term of this patent is extended or adjusted under 35 U.S.C. 154(b) by 965 days.

(21) Appl. No.: 11/712,290

(22) Filed: Feb. 28, 2007

Related U.S. Application Data

(63) Continuation-in-part of application No. 11/325,003, filed on Jan. 3, 2006, now abandoned, which is a continuation of application No. 11/026,645, filed on Dec. 31, 2004, now Pat. No. 7,114,300, which is a continuation of application No. 10/634,685, filed on Aug. 6, 2003, now Pat. No. 6,845,871, which is a continuation-in-part of application No. 10/192,940, filed on Jul. 11, 2002, now Pat. No. 6,615,999, which is a continuation-in-part of application No. 09/307,229, filed on May 7, 1999, now abandoned.

(51) Int. Cl.
*E06B 1/04* (2006.01)

(52) U.S. Cl. ..... 52/211; 52/79.5; 211/186

(58) Field of Classification Search ..... 52/211, 52/79.1, 79.5, 667, 79.2, 79.7; 211/186, 211/184, 189, 27
See application file for complete search history.

(56) References Cited

U.S. PATENT DOCUMENTS

| | | | | |
|---|---|---|---|---|
| 1,393,679 | A | | 10/1921 | Forster |
| 1,903,631 | A | | 4/1933 | Morrison |
| 2,075,473 | A | * | 3/1937 | Schwary et al. ..... 99/645 |
| 2,366,677 | A | * | 1/1945 | Rosenthal ..... 108/60 |
| 2,481,671 | A | | 9/1949 | John et al. |
| 2,854,724 | A | | 10/1958 | Wuorio |
| 3,069,216 | A | | 12/1962 | Vaeth |
| 3,300,245 | A | | 1/1967 | Rumble |
| 3,638,814 | A | | 2/1972 | Lowery |
| 3,669,033 | A | | 6/1972 | Murcia |
| 3,812,977 | A | | 5/1974 | Glassman |
| 4,190,738 | A | | 2/1980 | Samuels |
| 4,192,562 | A | | 3/1980 | Bishoff et al. |
| 4,562,776 | A | | 1/1986 | Miranda |
| 4,565,042 | A | | 1/1986 | von Poschinger-Camphausen |
| 4,715,503 | A | | 12/1987 | Johnson |
| 4,807,539 | A | | 2/1989 | Del Castillo von Haucke |
| D358,725 | S | * | 5/1995 | Stender ..... D6/407 |
| D416,714 | S | * | 11/1999 | Ziliani ..... D6/479 |
| 6,174,116 | B1 | | 1/2001 | Brand |

* cited by examiner

*Primary Examiner*—Basil Katcheves
(74) *Attorney, Agent, or Firm*—Chambliss, Bahner & Stophel, P.C.

(57) ABSTRACT

A modular assembly system comprising a plurality of structural members. Each of the structural members has at least one slot along a lengthwise side of the member. Each of the structural members is also defined by a unique spaced relationship between the predetermined slot-to-side distance and the slot-to-slot distance. The slot-to-slot distance is a whole-number multiple of the predetermined slot-to-side distance. Each of the at least one along a lengthwise side of each of the plurality of structural members is adapted to be detachably and selectively connected slot-to-slot to one of all of the slots along one of the lengthwise sides of each of the other structural members. In the preferred embodiments, the system also includes a circular support structure and an arcuate support structure.

4 Claims, 23 Drawing Sheets

FIGURE 5
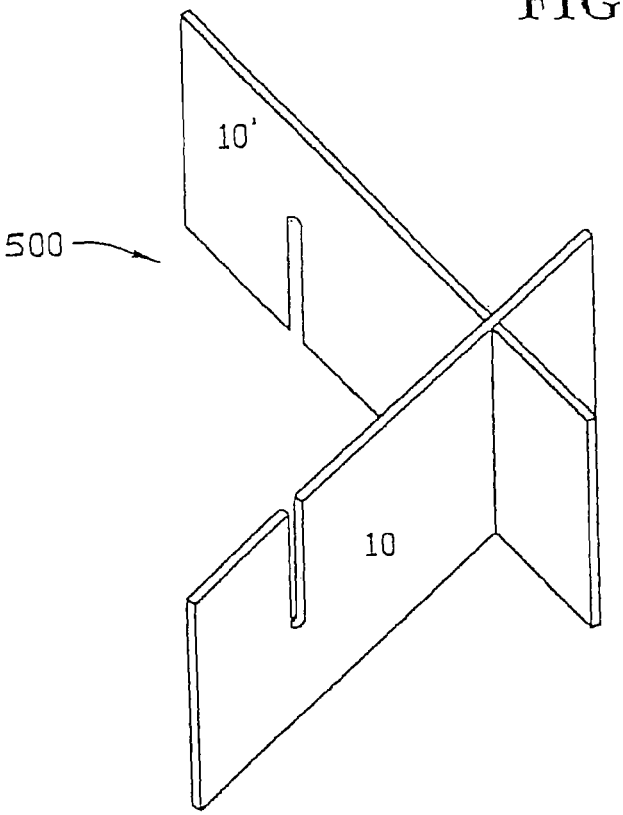
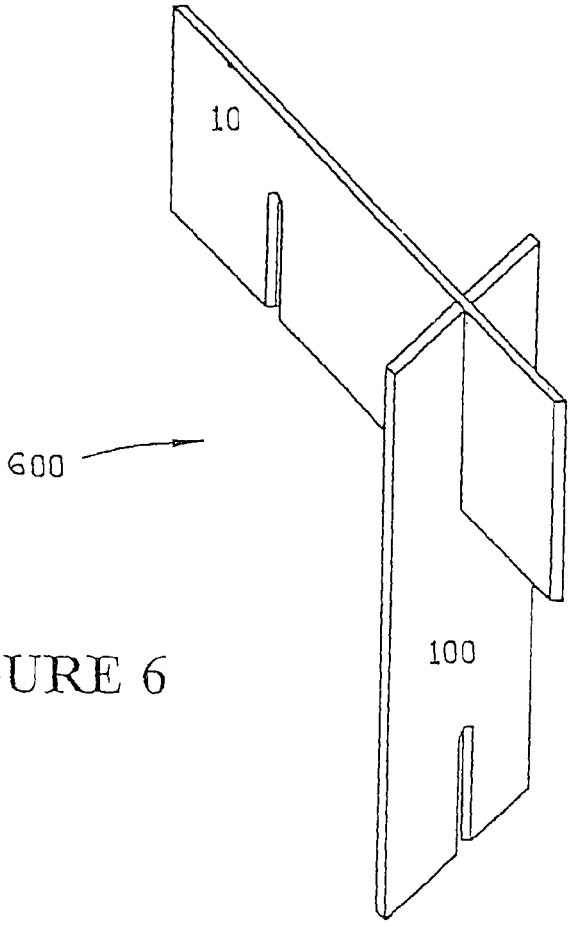
FIGURE 6

MODULAR ASSEMBLY SYSTEM

CROSS-REFERENCE TO RELATED APPLICATIONS

This application is a continuation-in-part application of the continuation application entitled Modular Assembly System, which was filed on Jan. 3, 2006 now abandoned and assigned Ser. No. 11/325,003. The continuation application was filed as a co-pending application of a continuation application entitled System for Modular Assembly, which was filed on Dec. 31, 2004, assigned Ser. No. 11/026,645 and issued as U.S. Pat. No. 7,114,300. The continuation application was filed as a co-pending application of continuation application entitled Modular Construction System, which was filed on Aug. 6, 2003, assigned Ser. No. 10/634,685 and issued as U.S. Pat. No. 6,845,871. The continuation application was filed as a co-pending application of the continuation-in-part application entitled System for Modular Construction, which was filed on Jul. 11, 2002, assigned Ser. No. 10/192,940 and issued as U.S. Pat. No. 6,615,999. The continuation-in-part application was filed as a co-pending application of the application entitled System for Modular Construction, which was filed on May 7, 1999, assigned a Ser. No. 09/307,229, and subsequently abandoned. The disclosures of the co-pending continuation application, the issued continuation application, the issued continuation-in-part application and the abandoned application are fully incorporated herein by reference.

FIELD OF INVENTION

This invention relates generally to an apparatus for producing a scalable, modular construction from a plurality of structural members having certain standardized features. More particularly, the invention relates to a system for modular construction that is capable of producing assembled units of infinite scalability using interchangeable structural members having detachably connecting slots defined by a standardized spacing model. The apparatus of the invention permits the construction of an endless variety of structurally stable arrangements using a plurality of interchangeable and replaceable structural members without the use of tools or fastening devices.

BACKGROUND AND DESCRIPTION OF THE PRIOR ART

It is known to connect a plurality of structural members using complementary slots to form assembled constructions. For example, U.S. Pat. No. 2,854,724 of Wuorio discloses a molding apparatus comprising a plurality of structural members. According to the Wuorio patent, each structural member has two parallel sides extending lengthwise and two parallel sides extending widthwise whereby an equal thickness is defined between two planar sides. In addition, the structural members have slots, and each slot has a pair of sides, an end, and a center line. The slots of the structural members engage each other in order to assemble the molding apparatus of the invention.

Another example of such an apparatus is disclosed by U.S. Pat. No. 3,069,216 of Vaeth. The Vaeth patent discloses a desk that is assembled by connecting complementary slots on a plurality of structural members. The structural members of the apparatus have slots of varying depth on one or more sides of the structural members. Like the Wuorio apparatus, each of the slots in the structural members of the Vaeth desk are defined by an open end, a closed end, and a pair of sides.

The previously-described devices, however, each suffer from one or more disadvantages. None of the previously-described devices can be enlarged by adding additional structural members. For example, the molding apparatus of the Wuorio patent cannot be expanded upon to produce a molding apparatus comprising more structural members than are illustrated in FIG. 9. Instead, the Wuorio patent discloses a molding apparatus that is locked into an assembled construction using locking element 16 such that the assembled structure cannot be expanded. Thus, the molding apparatus of the Wuorio patent cannot exceed the length of its longest structural member or the width of its widest structural member. Simply put, the molding apparatus of the Wuorio patent cannot be "grown" outside the box created by the four largest molding elements. Similarly, the desk of the Vaeth patent cannot be expanded to produce a desk comprising more structural members than are illustrated in FIGS. 1 through 3 and 6. The desk of the Vaeth patent cannot be expanded by adding a second desktop or another pedestal of bookshelves. Thus, both the Wuorio patent and the Vaeth patent describe devices limited in size by the dimensions of their largest individual structural members. Consequently, neither Wuorio nor Vaeth disclose devices that are scalable. Scalability is the ability to duplicate, or replicate ad infinitum, subassemblies of structural members to produce a larger assembled unit. When scaling is employed, a plurality of subassemblies are detachably connected together with one or more connecting members to produce a larger assembled unit.

It would be desirable, therefore, if a system of modular construction were developed that could be used to produce an assembled unit from a plurality of subassemblies of structural members and one or more connecting members. It would also be desirable if such a system were developed that could be used to connect a plurality of subassemblies in a non-planar or "brick and mortar" style construction. It would be further desirable if such a system were developed that allowed for the replacement of like structural members with unlike structural members to make repair and replacement easier and less expensive. It would be still further desirable is such a system were developed that allowed for the construction of structurally stable assemblies of limitless dimensions without the use of tools or fastening devices.

ADVANTAGES OF THE INVENTION

Accordingly, it is an advantage of the invention claimed herein to provide an apparatus for a system of modular construction that may be used to produce an assembled unit from a plurality of subassemblies of structural members and one or more connecting members. It is another advantage of the invention to provide a system that can be used to connect a plurality of subassemblies in a non-planar or "brick and mortar" style construction. It is yet another advantage of the invention to provide a system that allows for the replacement of like structural members with unlike structural members so that repair and replacement of the structural members is easier and less expensive. It is also and advantage of the invention to provide a system that allows for the construction of structurally stable assemblies of limitless dimensions without the use of tools or fastening devices.

Additional advantages of this invention will become apparent from an examination of the drawings and the ensuing description.

EXPLANATION OF TECHNICAL TERMS

As used herein, the term "arcuate support structure" refers to any support structure having at least one side that is curved, arched, wavy or otherwise non-linear in configuration.

As used herein, the term "circular support structure" refers to any support structure having a circular, ovate, or elliptical configuration.

As used herein, the phrase "connected slot-to-slot" describes a detachable connection made between complementary slots on two structural members. According to the invention, structural members are "connected slot-to-slot" by press-fitting a slot on one structural member into a slot on another structural member while the structural members are generally perpendicular to each other. When structural members are "connected slot-to-slot," the result is a snug but detachable engagement between the structural members.

As used herein, a "connecting member" is a structural member having at least two slots that is detachably connected slot-to-slot to a structural member of one subassembly and to a structural member of another subassembly. According to the invention, a "connecting member" may be detachably connected slot-to-slot to more than one structural member of one subassembly and/or more than one structural member of another subassembly. In addition, a "connecting member" may be detachably connected slot-to-slot to more than two different subassemblies.

As used herein, the term "predetermined slot-to-side distance" is the distance measured from a side of a structural member to a slot axis of the slot nearest said side. More particularly, for a preferred structural member having one or more slots on a lengthwise side, the "predetermined slot-to-side distance" is the distance from a widthwise side to the slot axis of the slot on a lengthwise side that is located nearest the widthwise side. For a preferred structural member having one or more slots on a widthwise side, the "predetermined slot-to-side distance" is the distance from a lengthwise side to the slot axis of the slot on a widthwise side that is located nearest the lengthwise side. It is understood that the "predetermined slot-to-side distance" may be a feature of structural members that are rectangular (including those that are square), as well as structural members of other shapes. For non-rectangular members, the "predetermined slot-to-side distance" is the distance from the slot axis of the slot nearest the nearest end of the side on which it is located to said end of said side.

As used herein, the term "radial distance" refers to the distance measured along a line substantially parallel to the curved lengthwise side of an arcuate support structure.

As used herein, the term "slot" is a long, narrow opening in a structural member which adapted to be detachably connected to a "slot" in another structural member. Each "slot" of the system of the invention is defined by an open end, a closed end opposite said open end, and a pair of equal-lengthed, parallel slot sides extending between the open end and the closed end. The open end of each "slot" of the system is located along a member side of a structural member. Each "slot" of the system also includes a slot axis as defined below.

As used herein, the term "slot axis" is an imaginary straight line extending between the open end and closed end of a slot. The "slot axis" of each slot in the system is parallel to and equally-spaced between the slot sides.

As used herein, the term "whole-number multiple of the predetermined slot-to-side distance" is any whole number multiple of the predetermined slot-to-side distance as that term is defined above. The term "whole-number multiple of the predetermined slot-to-side distance" includes the whole number multiple 1.

SUMMARY OF THE INVENTION

A modular assembly system comprising a plurality of structural members. Each of the plurality of structural members comprise a first lengthwise side and a second lengthwise side opposite the first lengthwise side. Each of the lengthwise sides are generally parallel to each other. Each of the plurality of structural members also comprise a first widthwise side and a second widthwise side opposite the first widthwise side. Each of the widthwise sides are generally parallel to each other. Each of the plurality of structural members further comprise at least one slot along one of the lengthwise sides. Each of the at least one slot comprises a pair of generally parallel slot sides, an open end along one of the lengthwise sides and a slot axis parallel to and disposed equally between the slot sides. The distance between the slot axis of the slot nearest to the first widthwise side and the first widthwise side is a predetermined slot-to-side distance and the distance between the slot axis of the slot nearest to the second widthwise side and the second widthwise side is a whole-number multiple of the predetermined slot-to-side distance. The distance between each of the slot axes of the at least one slot along one of the lengthwise sides is a whole-number multiple of the predetermined slot-to-side distance. Each of the at least one slot along one of the lengthwise sides of the plurality of structural members is adapted to be detachably and selectively connected slot-to-slot to one of all of the at least one slot along one of the lengthwise sides of each of the other of said plurality of structural members.

In one preferred embodiment of the modular assembly system, the plurality of structural members comprises a first vertical structural member, a second vertical structural member, a third vertical structural member, a first horizontal structural member, a second horizontal structural member and a third horizontal structural member. In another preferred embodiment, the plurality of structural members comprises a first vertically-disposed structural member, a second vertically-disposed structural member and a third vertically-disposed structural member, and the system further comprises a circular support structure. In yet another preferred embodiment, the plurality of structural members comprises a first vertically-disposed structural member, a second vertically-disposed structural member and a third vertically-disposed structural member, and the system further comprises an arcuate support structure.

BRIEF DESCRIPTION OF THE DRAWINGS

The presently preferred embodiments of the invention are illustrated in the accompanying drawings, in which like reference numerals represent like parts throughout, and in which:

FIG. 5 depicts an exemplary subassembly of two structural members, each having slots in a lengthwise side in accordance with the present invention.

FIG. 6 depicts an exemplary subassembly of one structural member having slots in a lengthwise side and one structural member having a slot in each widthwise side in accordance with the present invention.

DESCRIPTION OF THE PREFERRED EMBODIMENTS OF THE INVENTION

Figure 1A:
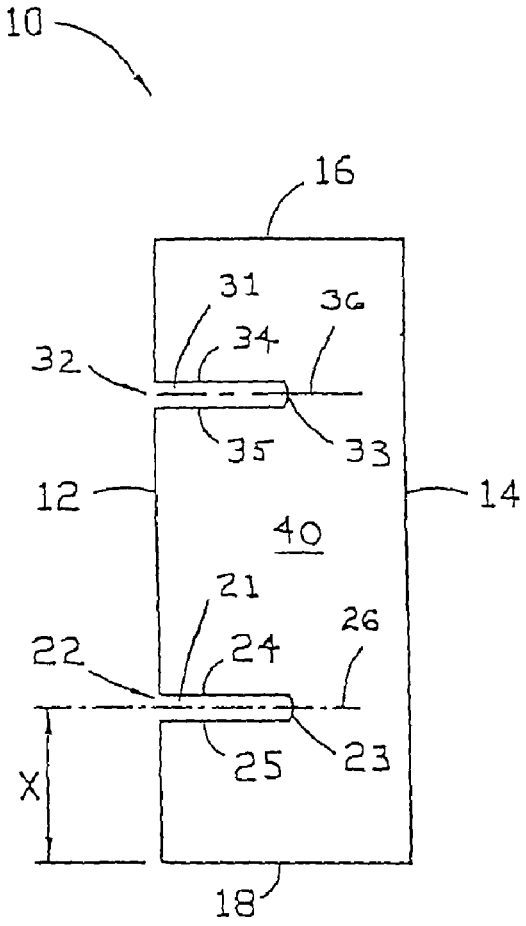
FIG. 1*a* depicts a representative structural member having slots in a lengthwise side in accordance with the present invention.

Referring now to the drawings, FIGS. 1*a* through 18 illustrate various embodiments of the apparatus of the invention. The basic unit of construction for the system of the invention is a structural member adapted to be detachably connected slot-to-slot to one or more other structural members. Structural member 10 comprises two equal-lengthed, parallel lengthwise sides 12, 14 and two equal-lengthed, parallel widthwise sides 16, 18. Structural member 10 is merely representative of the possible configurations of structural members according to the invention. While the preferred structural member of the system is rectangular in shape, a structural member may be any suitable conventional shape having at least three sides such as a triangle, a square, a trapezoid, another polygon or the like. It is also contemplated that one or more sides of a structural member may be arcuate, curved, bowed, bending, wavy, or angled.

As shown in FIG. 1*a*, exemplary structural member 10 also includes a pair of first member slots 21 and 31 along lengthwise side 12. More particularly, slot 21 is defined by open end 22, closed end 23 opposite open end 22, and a pair of parallel, equal-lengthed slot sides 24 and 25. In addition, slot 21 has slot axis 26 which is parallel to slot sides 24 and 25 and spaced equally between the slot sides. Slot 31 is defined by open end 32, closed end 33 opposite open end 32, and a pair of equal-lengthed, parallel slot sides 34 and 35. In addition, slot 31 has slot axis 36 which is parallel to slot sides 34 and 35 and spaced equally between the slot sides.

Consistent with structural member 10 illustrated in FIG. 1*a*, each slot of the system is defined by an open end, a closed end, and a pair of slot sides extending between the open end and the closed end. The open end of each slot is located along a side of the structural member by which it is defined. The closed end of each slot is opposite the open end. The open end is connected to the closed end by a pair of equal-lengthed, parallel slot sides that extend from the open end to the closed end. Each slot axis is parallel to the slot sides.

Each slot of the system is also defined by a slot depth. The slot depth is defined as the distance from the closed end of the slot to the open end of the slot along a line parallel to the slot sides. The slot depth of each slot on a structural member may be uniform or it may vary. In addition, the slot depth of slots on different structural members may be the same or different. In the preferred embodiment of the invention, the slot depth of each slot in an assembled unit is equal.

Each slot is also defined by a slot width. The slot width is defined as the distance from one slot side to the other slot side along a line perpendicular to the slot sides. In the preferred embodiment of the system, the slot width of all slots is substantially equal to the thickness of each structural member so that every structural member is adapted to be snugly connected slot-to-slot to every other structural member. It is also contemplated that a structural member may include slots having different slot widths and that different structural members may include slots having different slot widths. It is recognized, however, that in order for two structural members of the system to be detachably connected according to the invention, each structural member must include at least one slot having a slot width substantially equal to the thickness of the structural member to which it is connected.

Still referring to FIG. 1*a*, because each of the slots defined by structural member 10 is located along lengthwise side 12, slot axis 26 and slot axis 36 are generally parallel to widthwise sides 16, 18. It is understood that in the preferred structural member, i.e. a rectangular member, a slot along a lengthwise side has slot sides and a slot axis that are parallel to the widthwise sides of the structural member. On the other hand, a preferred structural member including a slot along a widthwise side has slot sides and a slot axis that are parallel to the lengthwise sides of the structural member.

Figure 1B:
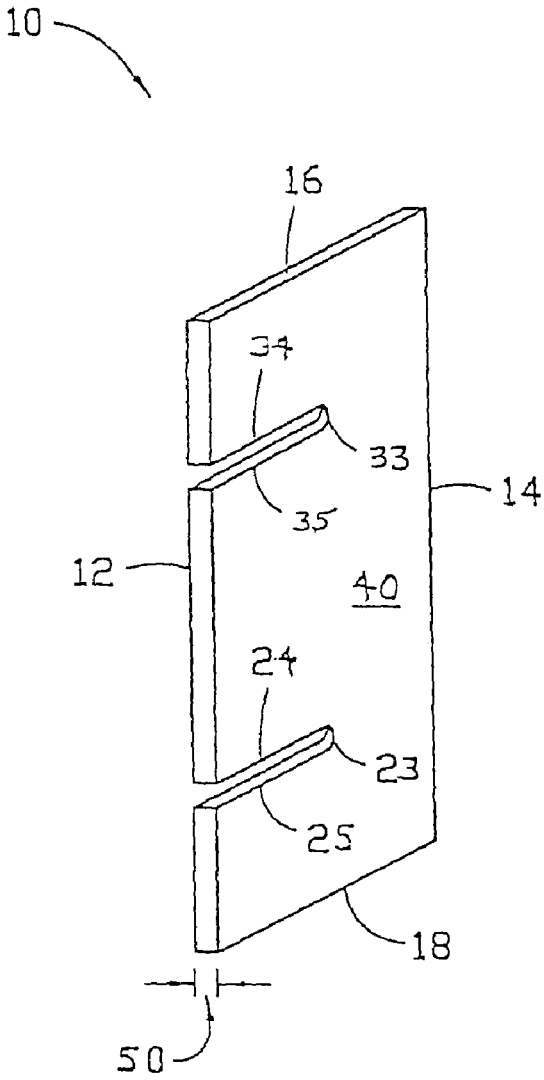
FIG. 1*b* depicts a perspective view of the representative structural member depicted in FIG. 1*a*.

Referring now to FIG. 1*b*, lengthwise sides 12, 14 and widthwise sides 16, 18 define first planar side 40 and a second planar side (not shown), the planar sides being in parallel planar disposition with respect to each other. The two planar sides of the structural member define thickness 50. It is understood that each structural member of the system defines a pair of parallel, coextensive planar surfaces which define a thickness. While the thickness of each preferred structural member is defined by a pair of parallel, coextensive rectangular planar surfaces, it is contemplated within the scope of the invention that the planar surfaces may be any suitable shape as described above. In addition, the thickness of each structural member in the preferred system is substantially equal to that of each other member in the system so that each structural member of the system may be detachably connected slot-to-slot to every other structural member of the system. It is contemplated, however, that structural members may be provided in a variety of thicknesses in order to accommodate the specific requirements of various applications.

In addition, the lengthwise sides and/or widthwise sides of the structural member may be longer or shorter than those of exemplary structural member 10, as limited only, by practicality. In such configurations, it is understood that a structural member may define additional slots along any or all of its sides. However, as later described, the system specifically provides that any structural member may be removed and replaced with one or more unlike structural members as an alternative to altering the configuration of an individual structural member.

Further, while structural member 10 has two slots on one lengthwise side, it is contemplated within the scope of the invention that one or more slots may be located on any side or sides of a structural member. More particularly, in the preferred structural members, i.e. rectangular structural members, one or more slots may be located on either or both lengthwise sides. In addition, one or more slots may be located on either or both widthwise sides. Still further, one or more slots may be located on either or both lengthwise sides and either or both widthwise sides. It is understood that any side of a structural member having more than one slot is a multiple-slot side. It is further understood that a structural member may have more than one multiple-slot side in accordance with the invention.

Figure 2:
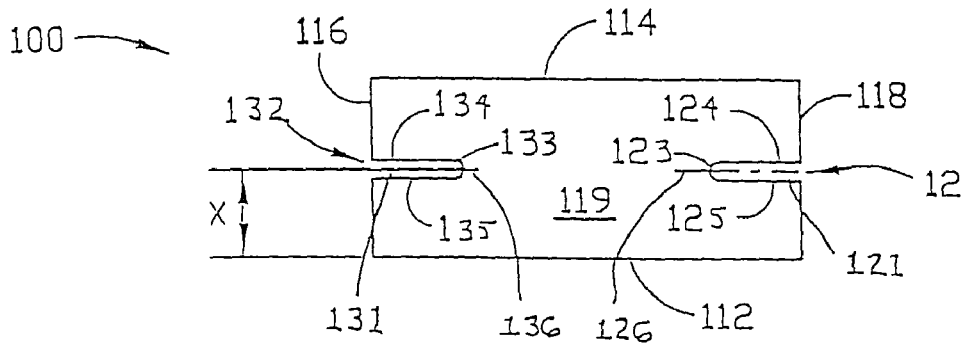
FIG. 2 depicts a representative structural member having a slot in each widthwise side in accordance with the present invention.

Referring now to FIG. 2, exemplary structural member 100 has one slot on each widthwise side. More particularly, structural member 100 comprises two equal-lengthed, parallel lengthwise sides 112, 114 and two equal-lengthed, parallel widthwise sides 116, 118. The respective lengthwise sides 112, 114 and widthwise sides 116, 118 define first planar side 119 and a second planar side (not shown), the respective planar sides being in parallel planar disposition with respect to each other. The first and second planar sides define a thickness (not shown). As depicted in representative structural member 100, slot 121 is located on widthwise side 118. Slot 121 is defined by open end 122, closed end 123, first side 124, and second side 125. Slot 121 also has slot axis 126 which is parallel to slot sides 124 and 125 and equally spaced between them. Slot 131 is located on widthwise side 116 of structural member 100. Slot 131 is defined by open end 132, closed end 133, first side 134, and second side 135. Slot 131 also has slot axis 136 which is parallel to slot sides 134 and 135 and equally spaced between them. As shown by FIG. 2, slot axes 126 and 136 are also parallel to lengthwise sides 112, 114.

Figure 3:
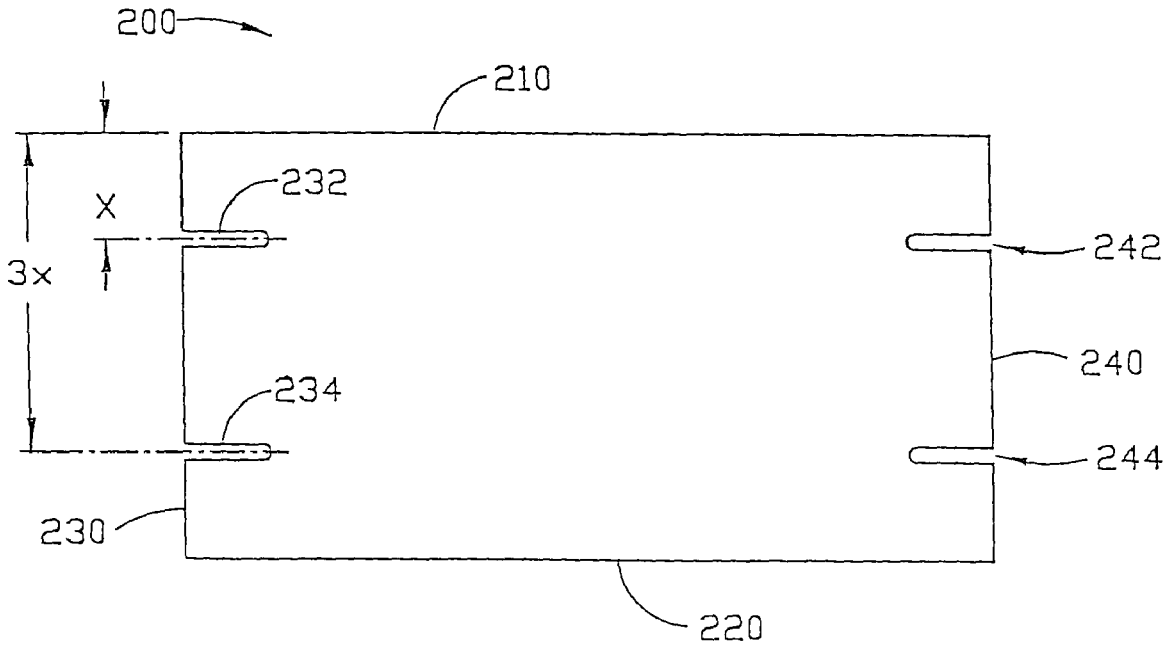
FIG. 3 depicts a representative structural member having a pair of slots in each widthwise side in accordance with the present invention.

FIG. 3 illustrates a structural member having two slots in each widthwise side. More particularly, structural member 200 comprises two equal-lengthed, parallel lengthwise sides 210, 220, and two equal-lengthed, parallel widthwise sides 230, 240. As shown by FIG. 3, structural member 200 includes slot 232, slot 234, slot 242, and slot 244. While FIG. 3 illustrates a preferred structural member having two slots on each widthwise side, it is contemplated within the scope of the invention that any side of a structural member may include more or less than two slots. Similarly, it is understood that the structural members depicted in FIGS. 1*a*, 1*b*, 2, and 3 are merely representative of the possible configurations of various structural members and the possible sides on which slots may be located.

According to the preferred system of the invention, each slot on a structural member is located along a side of the structural member according to a standardized spacing model. It is this standardized spacing model that provides the preferred system with such, advantages as scalability, "brick and mortar" style construction, and interchangeability of parts. The standardized spacing model of the preferred system is a function of two different distances.

The first relevant distance is the predetermined slot-to-side distance. For an exemplary structural member having one or more slots in a lengthwise side, the predetermined slot-to-side distance is the distance between a widthwise side of the structural member and the slot axis of the slot in the lengthwise side that is located nearest said widthwise side. Referring again to FIG. 1*a*, structural member 10 includes lengthwise sides 12, 14 and widthwise sides 16, 18. Two slots 21, 31 are located along lengthwise side 12, and each slot is parallel to widthwise sides 16, 18. Each slot is also an equal distance from the widthwise side of the structural member located nearest to such slot. More particularly, the slot axis of each slot is a predetermined slot-to-side distance X from the nearest widthwise side of the structural member. This predetermined slot-to-side distance X is the first relevant distance for the standardized spacing model.

Referring now to FIG. 2, the predetermined slot-to-side distance for an exemplary structural member having a slot on a widthwise side is illustrated. For such a structural member, the predetermined slot-to-side distance is the distance between a lengthwise side and the slot axis of the slot in the widthwise side that is located nearest said lengthwise side. As shown in FIG. 2, slot axis 126 of first slot 121 is a predetermined slot-to-side distance X from lengthwise side 114 along widthwise side 118. Referring to FIG. 3, the slot axis of slot 232 is a predetermined slot-to-side distance X from lengthwise side 210. Again, exemplary structural members 10, 100 and 200 are merely representative of the standardized spacing model as applied to the preferred rectangular-shaped structural members of the system. It is understood that the predetermined distance X may vary depending upon the application of the system. In other words, the predetermined distance X may be any convenient distance such as 6 inches, 9 inches, 12 inches, 18 inches, etc. In the preferred system, however, the predetermined distance X for all structural members of an assembled unit is equal. It is also understood that the predetermined slot-to-side distance for a structural member that is not rectangular in shape is the distance between the slot axis of the slot located nearest to the nearest end of a side and said end of said side.

According to the standardized spacing model, the second critical distance is the distance between the slot axes of a structural member having at least two slots on one side, i.e. on a multiple-slot side. More particularly, the distance between each slot axis on a structural member having at least two slots on one side is a whole number multiple of the predetermined slot-to-side distance X. It is contemplated that a whole number multiple includes 1, i.e., the distance between two slot axes of two slots on one side of a structural member may be equal to the predetermined slot-to-side distance X.

Figures 4A, 4B, 4C:
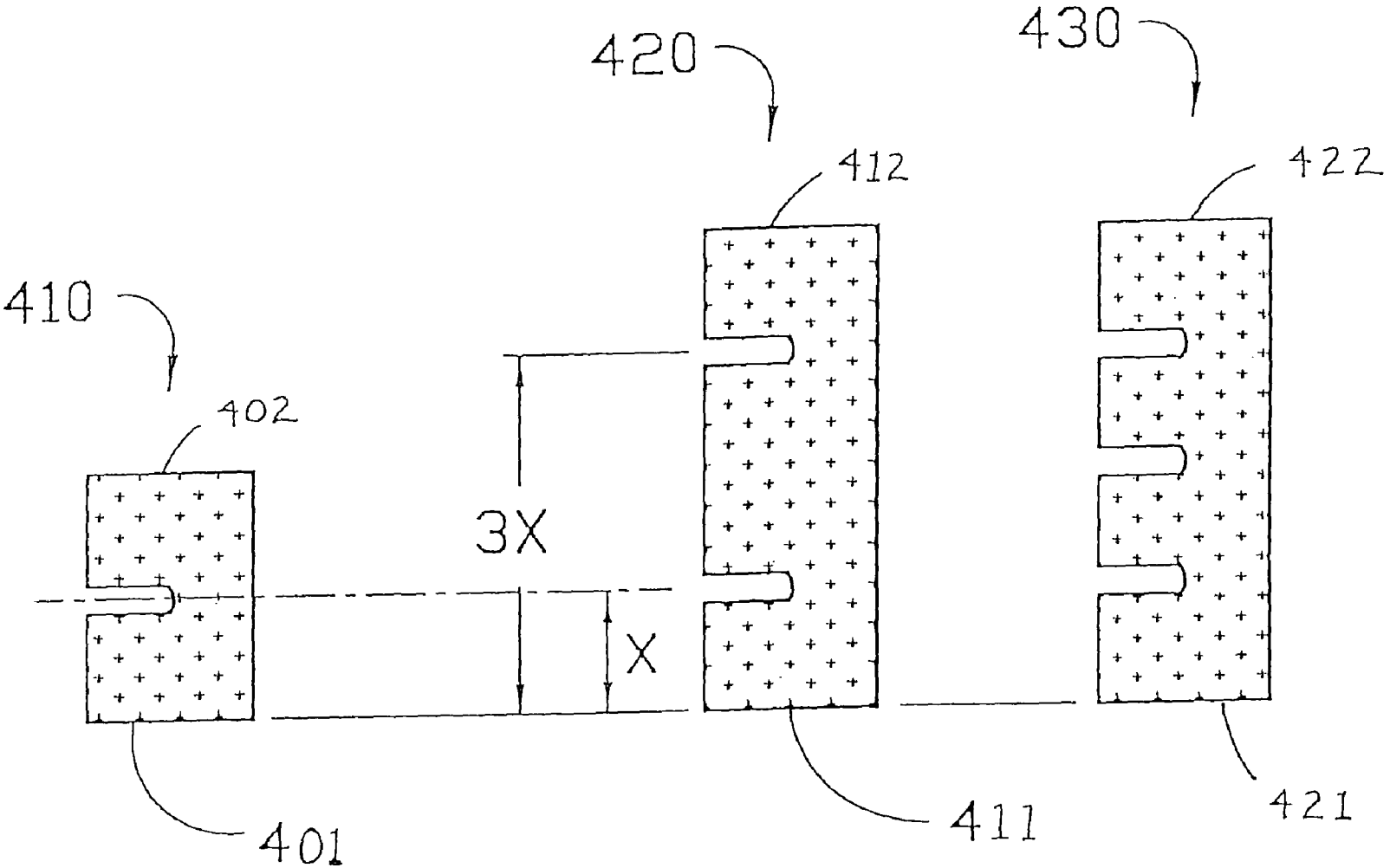
FIGS. 4*a* through 4*f* depict a selection of representative structural members having one or more slots in a lengthwise side in accordance with the present invention.

Referring to FIG. 3, exemplary structural member 200 has two slots on each widthwise side. The distance between the slot axes of slots 232 and 234 is 2X, or two times the predetermined slot-to-side distance X. Referring to FIG. 4*b*, structural member 420 has two slots on a lengthwise side. The distance between the slot axes of the two slots is 2X or two times the predetermined distance X. It is understood that the standardized spacing model applies to structural members having slots on one or more lengthwise sides and/or one or more widthwise sides, as well as to structural members having one or more slots on any or all of its sides.

Referring to FIGS. 4*a* through 4*f*, representative structural members having slots in a lengthwise side in accordance with the invention are depicted. As previously described with reference to FIGS. 1*a* and 1*b*, the predetermined slot-to-side distance X is the distance between a widthwise side and the slot axis of the slot nearest the widthwise side. As shown in FIGS. 4*a* through 4*f*, structural members 410, 420, 430, 440, 450 and 460 each have slots spaced apart from each other a whole-number multiple of the predetermined slot-to-side distance X. It should also be noted that the slot axis of any slot located on a lengthwise side of a preferred structural member is spaced apart from each widthwise side a whole-number multiple of the predetermined slot-to-side distance X. For example, referring to FIG. 4*b*, each slot of structural member 420 is spaced apart from each widthwise side a distance of either the predetermined slot-to-side distance X or 3 times the predetermined slot-to-side distance X.

Referring again to the representative examples depicted in FIGS. 4*a* through 4*f*, structural member 410 defines one slot at a predetermined slot-to-side distance X from widthwise side 401 and from widthwise side 402. Structural member 420 defines slots at distances X and 3X from widthwise side 411 and from widthwise side 412. Structural member 430 defines slots at distances X, 2X and 3X from widthwise side 421 and from widthwise side 422. Structural member 440 defines slots at distances X, 3X and 5X from widthwise side 431 and from widthwise side 432. Structural member 450 defines slots at distances X and 5X from widthwise side 441 and from widthwise side 442. Structural member 460 defines slots at distances X, 2X and 5X from widthwise side 451, and X, 4X, and 5X from widthwise side 452. Again, the structural members depicted are merely examples of the various embodiments contemplated within the scope of the invention.

Figures 4D, 4E, 4F:
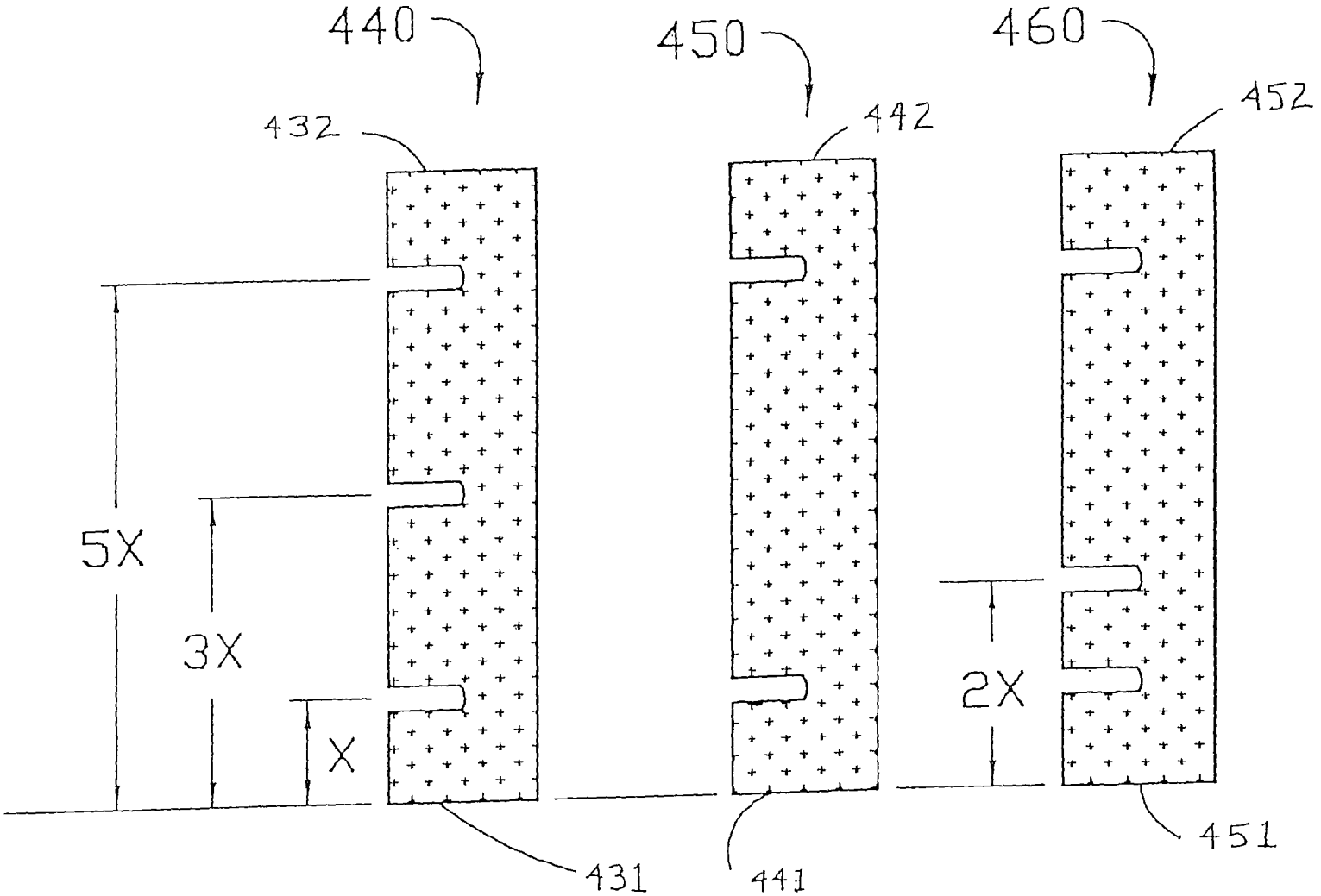

The overall length of structural members is also a whole number multiple of the predetermined slot-to-side distance X. For example, referring to FIG. 3, slot 234 is positioned a predetermined slot-to-side distance 3X from lengthwise side 210. In addition, slot 232 is located at three times the predetermined slot-to-side distance X from lengthwise side 220, and slot 234 is located at the predetermined slot-to-side distance X from lengthwise side 220. Therefore, the overall length of widthwise side 230 is 4X. Referring to FIGS. 4*d* through 4*f*, the overall length of structural members 440, 450, and 460 is 6X.

It should be understood that these illustrated structural members are merely representations of a few of the many slotting combinations possible in keeping with the spirit and scope of the present invention. Again, these illustrated structural members are merely examples of embodiments of the present invention intended the show the spacing relationship of slots within various structural members. Similarly, while the structural members depicted in FIGS. 4*a* through 4*f* depict defined slots on a single lengthwise side, it is understood and appreciated that slots may be defined on both lengthwise sides and/or on one or both widthwise sides, provided the standardizing spacing model described herein is applied. As with all structural members utilized in the present invention, the lengthwise sides and widthwise sides may vary without restriction, so long as the spacing relationship between slots and their respective lengthwise or widthwise sides, as defined herein, remains in accord with the standardized spacing model. In addition, it is also contemplated that structural members may have any number of slots equal to or greater than one on any one or more sides.

Referring now to FIG. 5, a simple subassembly of structural members is illustrated. More particularly, subassembly 500 depicts two structural members 10, 10', connected slot-to-slot using slots located along a lengthwise side of each of structural members 10, 10'. Importantly, for structural members such as 10 and 10' to be successfully connected slot-to-slot in a sufficiently rigidly subassembly 500, tolerances for slots as well as thicknesses of the structural members, must be carefully specified and closely monitored during production processes.

FIG. 6 depicts a representative subassembly 600 comprising structural member 10 having slots in a lengthwise side and structural member 100 having a slot in each widthwise side. The two respective structural members 10, 100 are connected slot-to-slot. Again, this is merely a representative example of different structural members connected slot-to-slot to produce a subassembly of structural members in accordance with the present invention.

As illustrated by FIGS. 5 and 6, the structural members of the system may be detachably connected in a variety of ways. According to the preferred system, a slot on a lengthwise side of a structural member may be detachably connected to a slot on a lengthwise side or to a slot on a widthwise side of another structural member. Similarly, according to the preferred system, a slot on a widthwise side of a structural member may be detachably connected to a slot on a lengthwise side or to a slot on a widthwise side of another structural member. Structural members having more than one slot on a side may be detachably connected with a slot from each of a plurality of other structural members.

Figure 7:
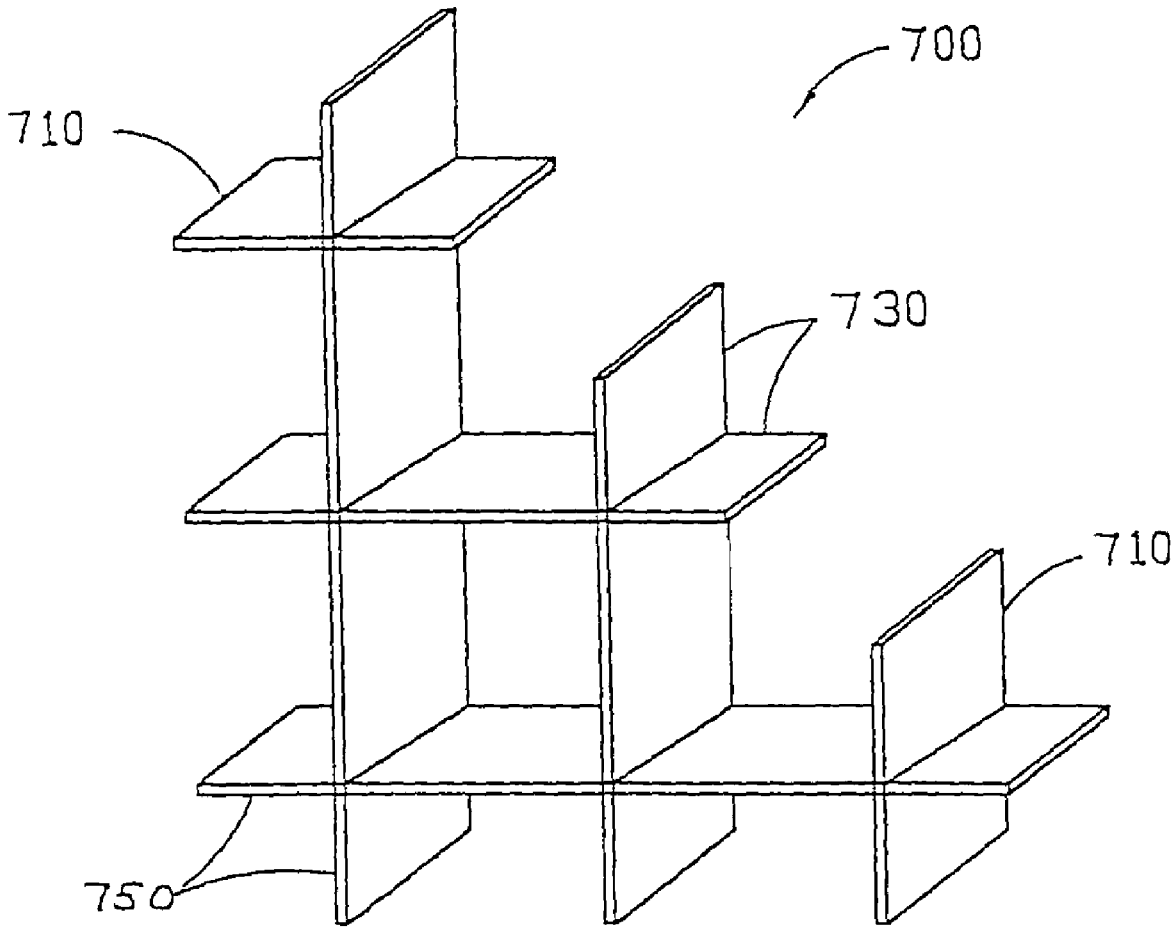
FIG. 7 depicts an exemplary subassembly of structural members, each having one or more slots in a lengthwise side in accordance with the present invention.
Figure 8:
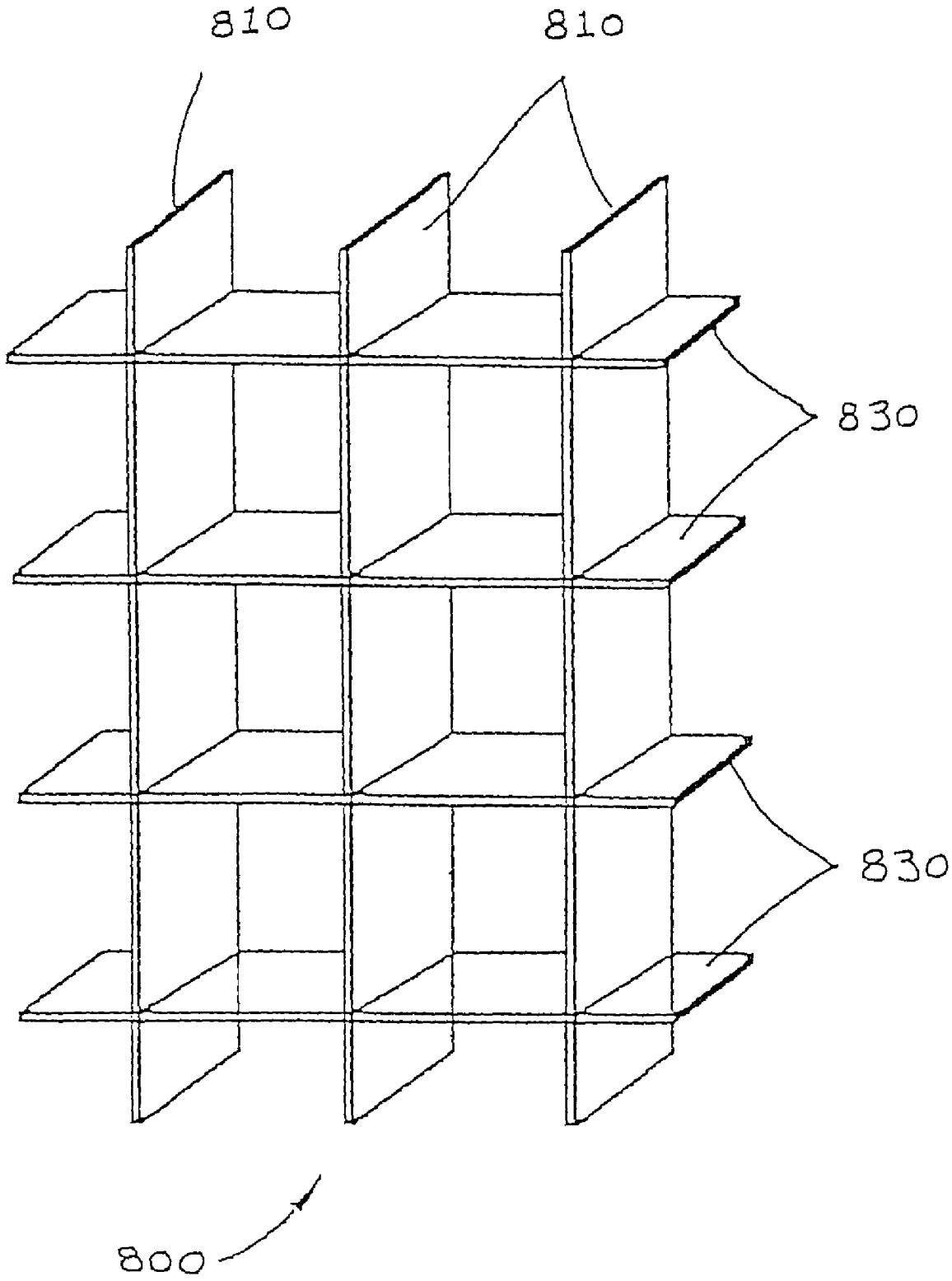
FIG. 8 depicts an exemplary subassembly of structural members, each having slots in a lengthwise side in accordance with the present invention.

More elaborate examples of subassemblies constructed in accordance with the present invention are depicted in FIGS. 7 and 8. Referring now to FIG. 7, subassembly 700 is comprised of a plurality of structural members connected slot-to-slot. More specifically, two structural members 710, each having a slot in a lengthwise side, two structural members 730, each having two slots in a lengthwise side, and two structural members 750, each having three slots in a lengthwise side are connected slot-to-slot to provide a versatile subassembly with a vast array of possible applications.

FIG. 8 depicts an example of another subassembly in accordance with the present invention. More particularly, subassembly 800 comprises three structural members 810, each having four slots in a lengthwise side and four structural members 830, each having three slots in a lengthwise side. It is understood that FIGS. 7 and 8 are merely representative of the variety of subassemblies that may be constructed according to the present invention.

Figure 9:
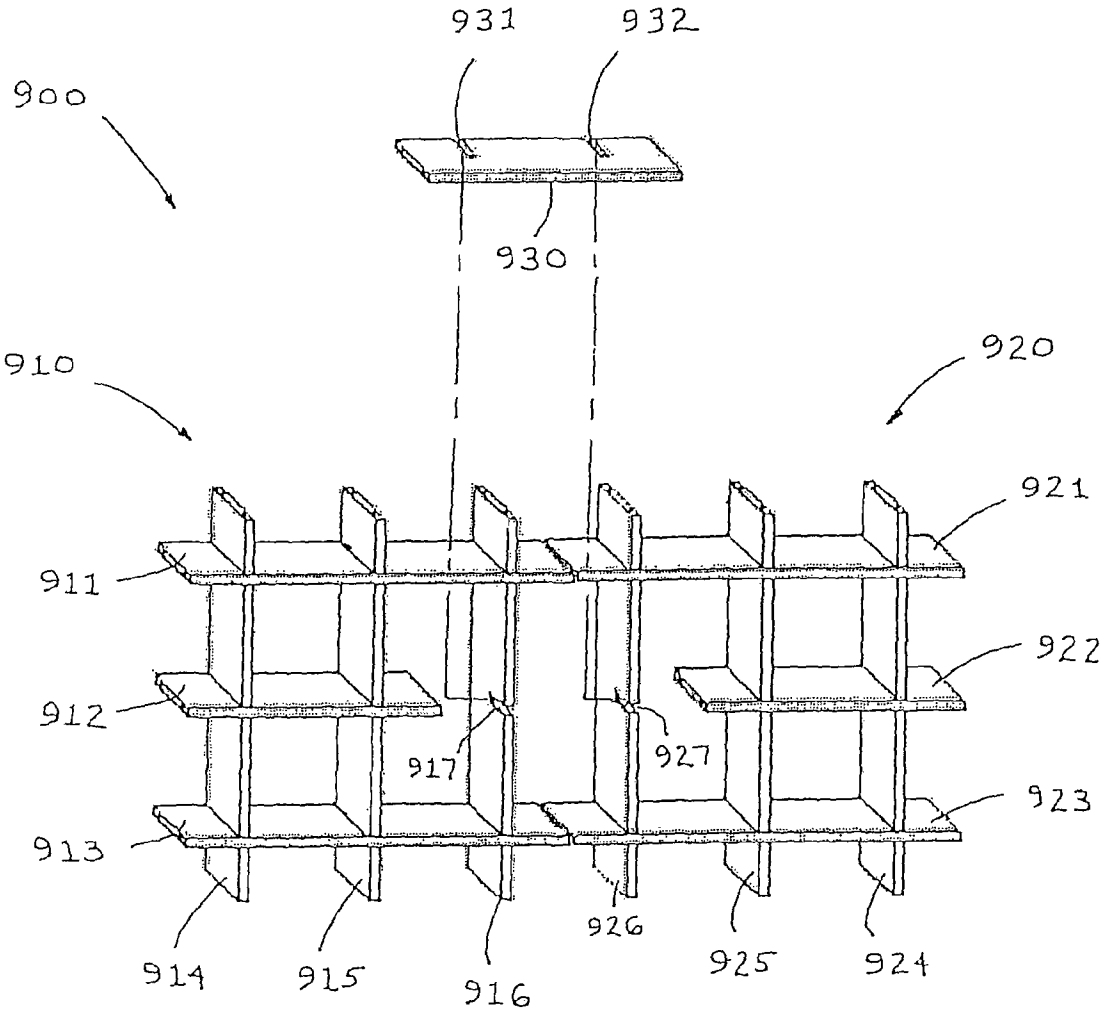
FIG. 9 depicts an exemplary assembled unit comprising two subassemblies of structural members, each having slots in a lengthwise side, and one connecting member having slots in a lengthwise side.

FIG. 9 depicts an example of an assembled unit constructed according to the system of the invention. As shown in FIG. 9, assembled unit 900 comprises first subassembly 910, second subassembly 920, and connecting member 930. More particularly, first subassembly 910 comprises a plurality of first structural members 911, 912, 913, 914, 915 and 916. Each of the first structural members has a plurality of first member sides. More particularly, each of the first structural members has four first member sides. Each of the first structural members also has at least one first member slot. More particularly, each of the first structural members has two or more slots in a lengthwise side. The plurality of first structural members are detachably connected slot-to-slot to produce the first subassembly.

Second subassembly 920 comprises a plurality of second structural members 921, 922, 923, 924, 925 and 926. Each of the plurality of second structural members has a plurality of second member sides. More particularly, each of the second structural members has four second member sides. Each of the second structural members also has at least one second member slot. More particularly, each of the second structural members has two or more slots in a lengthwise side. The plurality of second structural members are detachably connected slot-to-slot to produce the second subassembly.

First subassembly 910 and second subassembly 920 are detachably connected slot-to-slot by connecting member 930 to produce assembled unit 900. As shown in FIG. 9, connecting member 930 includes two slots 931, 932. Slot 931 of connecting member 930 is detachably connected slot-to-slot to slot 917 in structural member 916, and slot 932 of connecting member 930 is detachably connected slot-to-slot to slot 927 in structural member 926.

As described below, assembled unit 900 is merely one example of the possible ways in which an assembled unit may be constructed according to the system of the invention. The first and second subassemblies may be assembled from more structural members, fewer structural members, or different structural members. The first subassembly may be assembled from different structural members than the second subassembly. As described below, the assembled unit may comprise more than two subassemblies. In addition, the connecting member may be different from the two slot connecting member depicted in FIG. 9. For example, structural members 912 and 922 may be removed from subassembly 910 and 920, respectively, and connecting member 930 may be replaced with a preferred structural member having six slots in a lengthwise side.

Figure 9A:
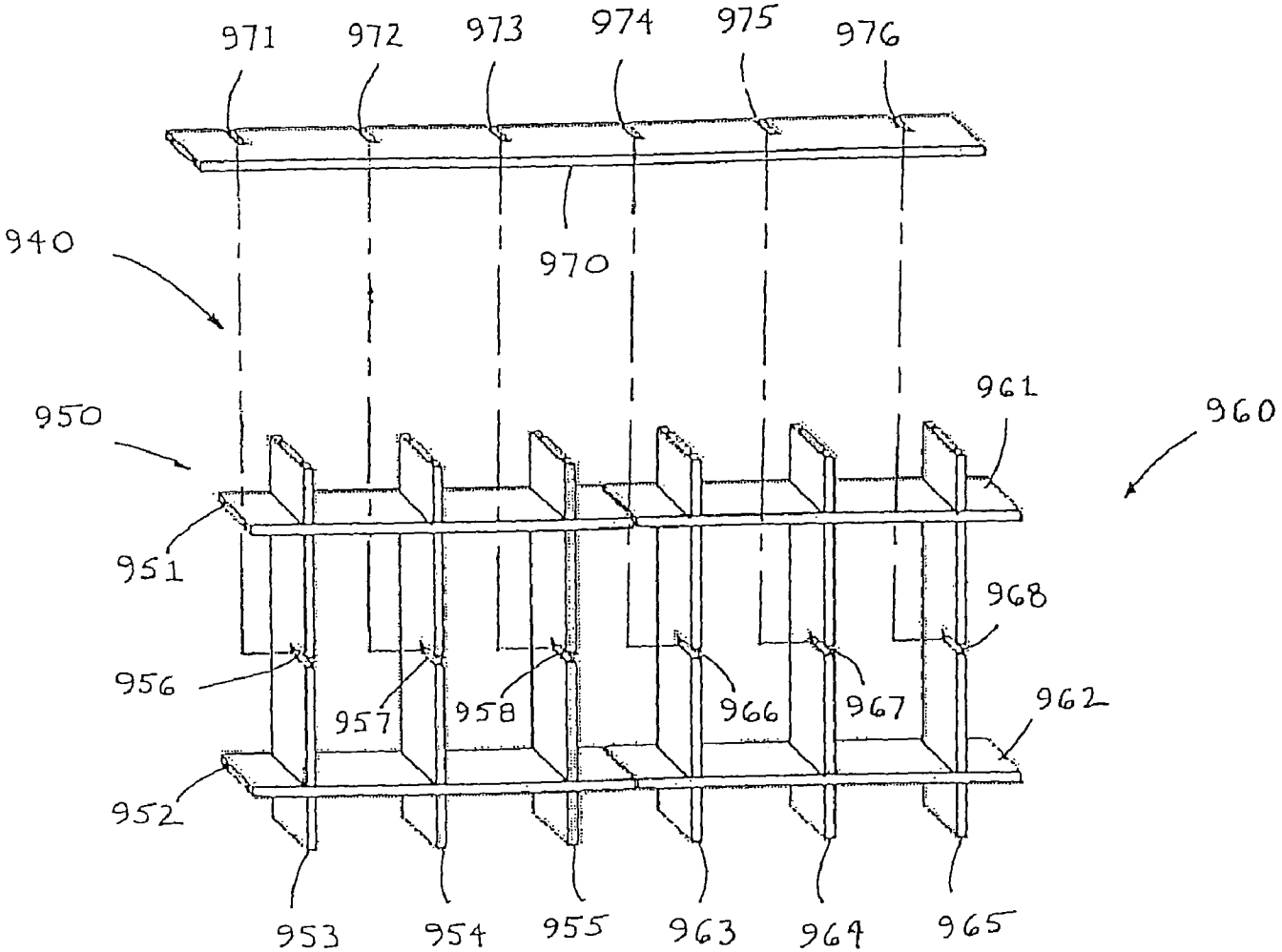
FIG. 9*a* depicts an exemplary assembled unit comprising two subassemblies of structural members, each having slots in a lengthwise side, and one connecting member having slots in a lengthwise side.

Referring now to FIG. 9*a*, assembled unit 940 comprises first subassembly 950, second subassembly 960, and connecting member 970. First subassembly 950 comprises structural members 951, 952, 953, 954, and 955. Each of the structural members of subassembly 950 are detachably connected slot-to-slot. Second subassembly 960 comprises structural members 961, 962, 963, 964, and 965. Each of the structural members of subassembly 960 are detachably connected slot-to-slot. Connecting member 970 includes six slots 971, 972, 973, 974, 975, and 976. Slots 971, 972, and 973 are detachably connected slot-to-slot to slot 956 in structural member 953, slot 957 in structural member 954, and slot 958 in structural member 955, respectively. Slots 974, 975, and 976 are detachably connected slot-to-slot to slot 966 in structural member 963, slot 967 in structural member 964, and slot 968 in structural member 965, respectively.

It is also contemplated within the scope of the invention that a connecting member having more or less than six slots may be used to connect the two subassemblies depicted by FIG. 9*a*. Furthermore, more than one connecting member may be used to connect the two subassemblies shown in FIGS. 9 and 9*a*. For example, referring to FIG. 9, structural members 911 and 921 may be removed from subassemblies 910 and 920, respectively, and replaced by a second connecting member having six slots on a lengthwise side. Similarly, referring to FIG. 9*a*, structural members 951 and 961 may be removed from subassemblies 950 and 960, respectively, and replaced by a second connecting member having six slots on a lengthwise side.

Figure 9B:
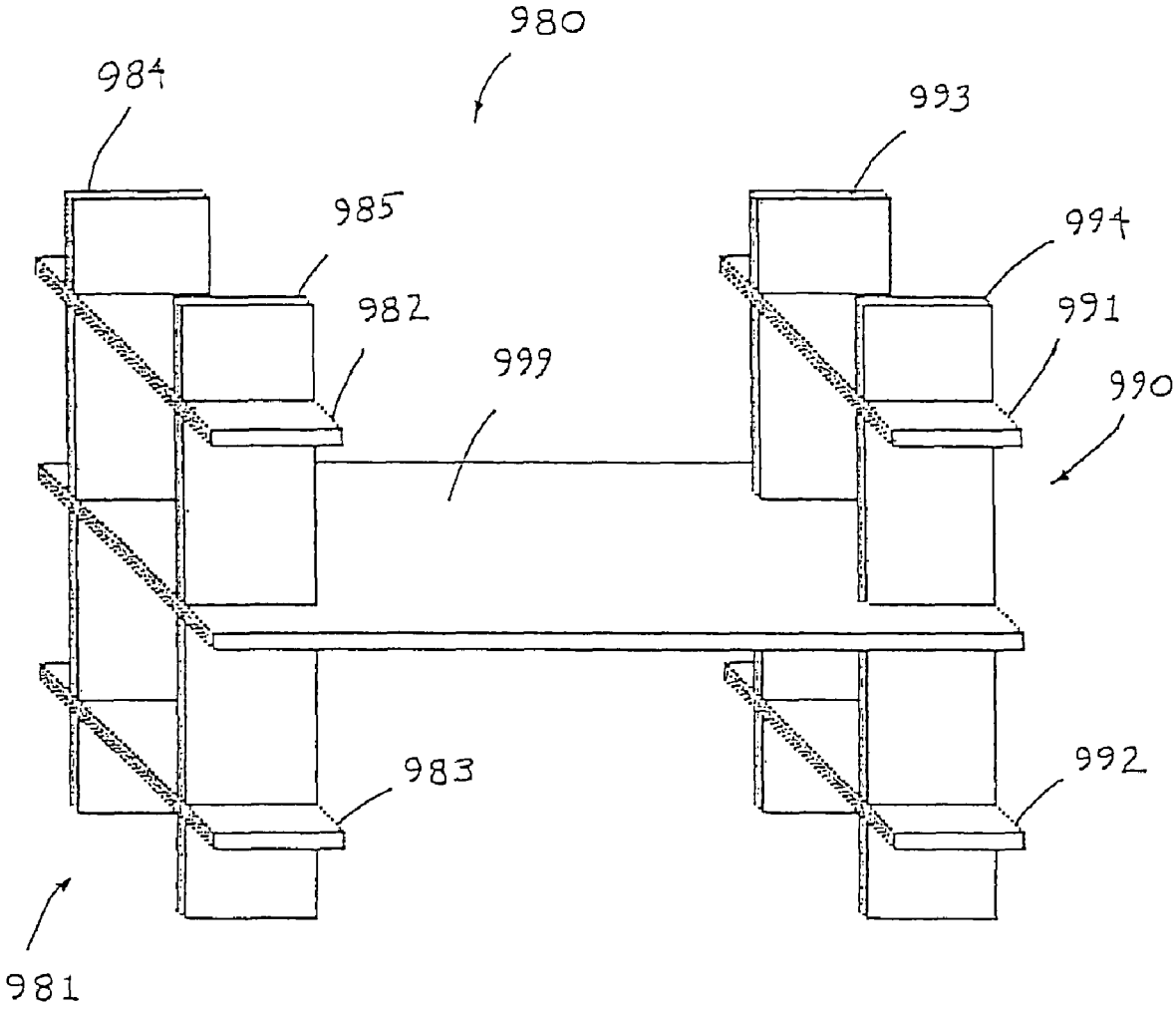
FIG. 9*b* depicts an exemplary assembled unit comprising two subassemblies of structural members, each having slots in a lengthwise side, and one connecting member having slots in each widthwise side.

FIG. 9*b* illustrates yet another assembled unit comprising a pair of subassemblies and one connecting member. As illustrated by FIG. 9*b*, assembled unit 980 comprises first subassembly 981, second subassembly 990, and connecting member 999. More particularly, first subassembly 981 includes structural members 982, 983, 984, and 985. Each of the structural members of the first subassembly are detachably connected slot-to-slot. In addition, each of the structural members of the first subassembly have first member slots in a lengthwise side. Second subassembly 990 includes structural members 991, 992, 993, and 994. Each of the structural members of the second subassembly are detachably connected slot-to-slot. In addition, each of the structural members of the second subassembly have second member slots in a lengthwise side. Connecting member 999 detachably connects first subassembly 981 to second subassembly 990. Furthermore, connecting member 999 has slots in each of its widthwise sides.

Thus, according to the system of the invention, one or more connecting members having slots in only the widthwise sides may be used to detachably connect one or more subassemblies having structural members with slots in a lengthwise side. Still further, one or more connecting members having slots in only the lengthwise sides may be used to detachably connect one or more subassemblies having structural members with slots in one or more widthwise sides.

Figure 10:
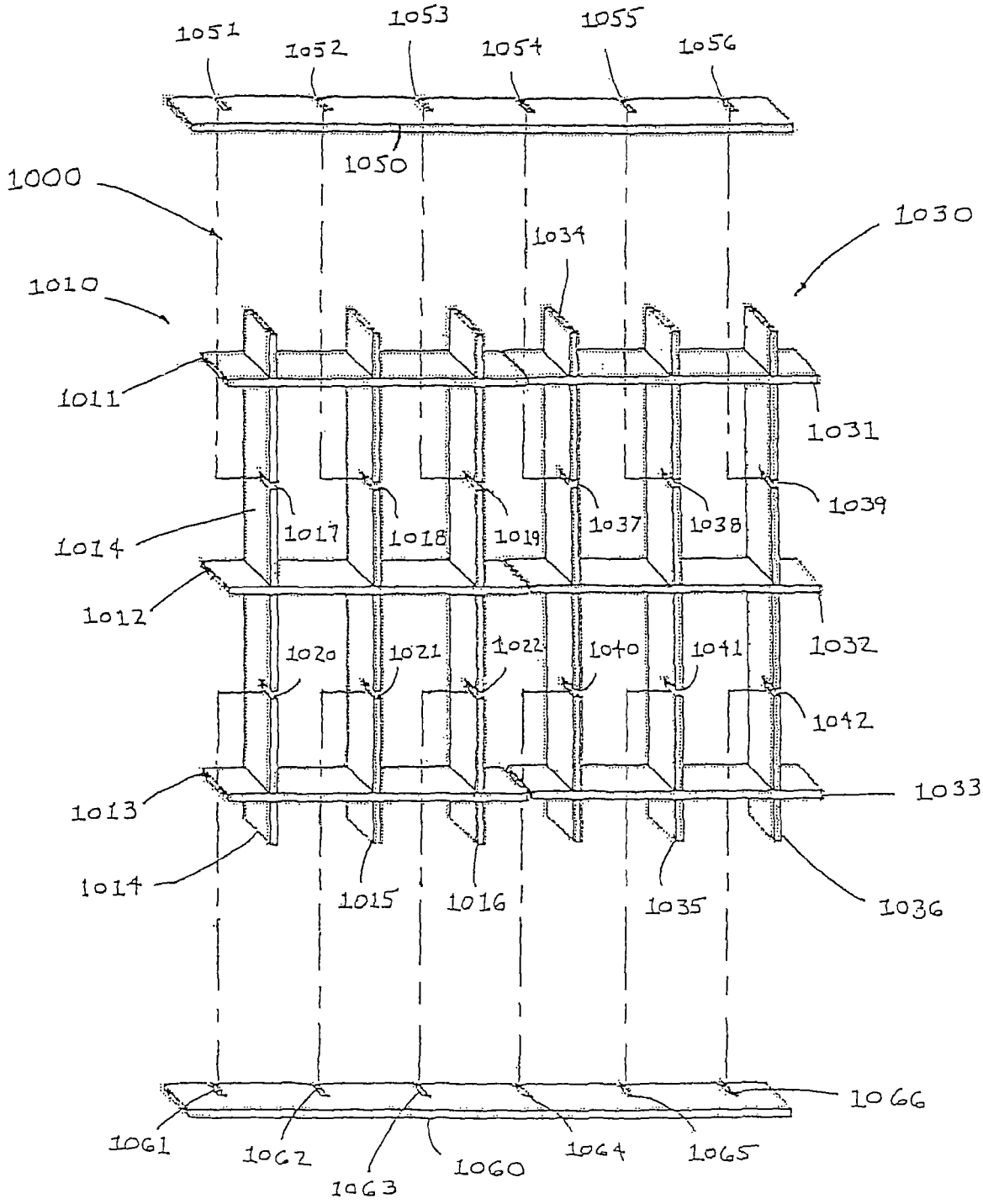
FIG. 10 depicts an exemplary assembled unit comprising two subassemblies of structural members, each having slots in a lengthwise side, and two connecting members, each having slots in a lengthwise side.

Referring now to FIG. 10, assembled unit 1000 comprises first subassembly 1010, second subassembly 1030, first connecting member 1050, and second connecting member 1060. First subassembly 1010 comprises structural members 1011, 1012, 1013, 1014, 1015, and 1016. Each of the structural members of the first subassembly are detachably connected slot-to-slot. Second subassembly 1030 comprises structural members 1031, 1032, 1033, 1034, 1035, and 1036. Each of the structural members of the second subassembly are detachably connected slot-to-slot. Connecting members 1050 and 1060 detachably connect the first subassembly to the second subassembly. More particularly, first connecting member 1050 includes slots 1051, 1052, 1053, 1054, 1055, and 1056. Slot 1051 is connected to slot 1017 in structural member 1014, slot 1052 is connected to slot 1018 in structural member 1015, and slot 1053 is connected to slot 1019 in structural member 1016. Slot 1054 is connected to slot 1037 in slot 1034, slot 1055 is connected to slot 1038 in slot in structural member 1035, and slot 1056 is connected to slot 1039 in structural member 1036. Second connecting member includes slots 1061, 1062, 1063, 1064, 1065, and 1066. Slot 1061 is connected to slot 1020 in structural member 1014, slot 1062 is connected to slot 1021 in structural member 1015, and slot 1063 is connected to slot 1022 in structural member 1016. Slot 1064 is connected to slot 1040 in structural member 1034, slot 1065 is connected to slot 1041 in structural member 1035, and slot 1066 is connected to slot 1042 in structural member 1036. It is contemplated within the scope of the invention that more or less than two connecting members may be used to connect first subassembly 1010 and second subassembly 1030. It is further contemplated that connecting members having more or less than six slots may be used to connect first subassembly 1010 and second subassembly 1030. It is also contemplated within the scope of the invention that a plurality of subassemblies may be detachably connected slot-to-slot by a plurality of unlike connecting members. Still further, it is contemplated that one or more connecting members may connect more than two subassemblies.

Figure 11:
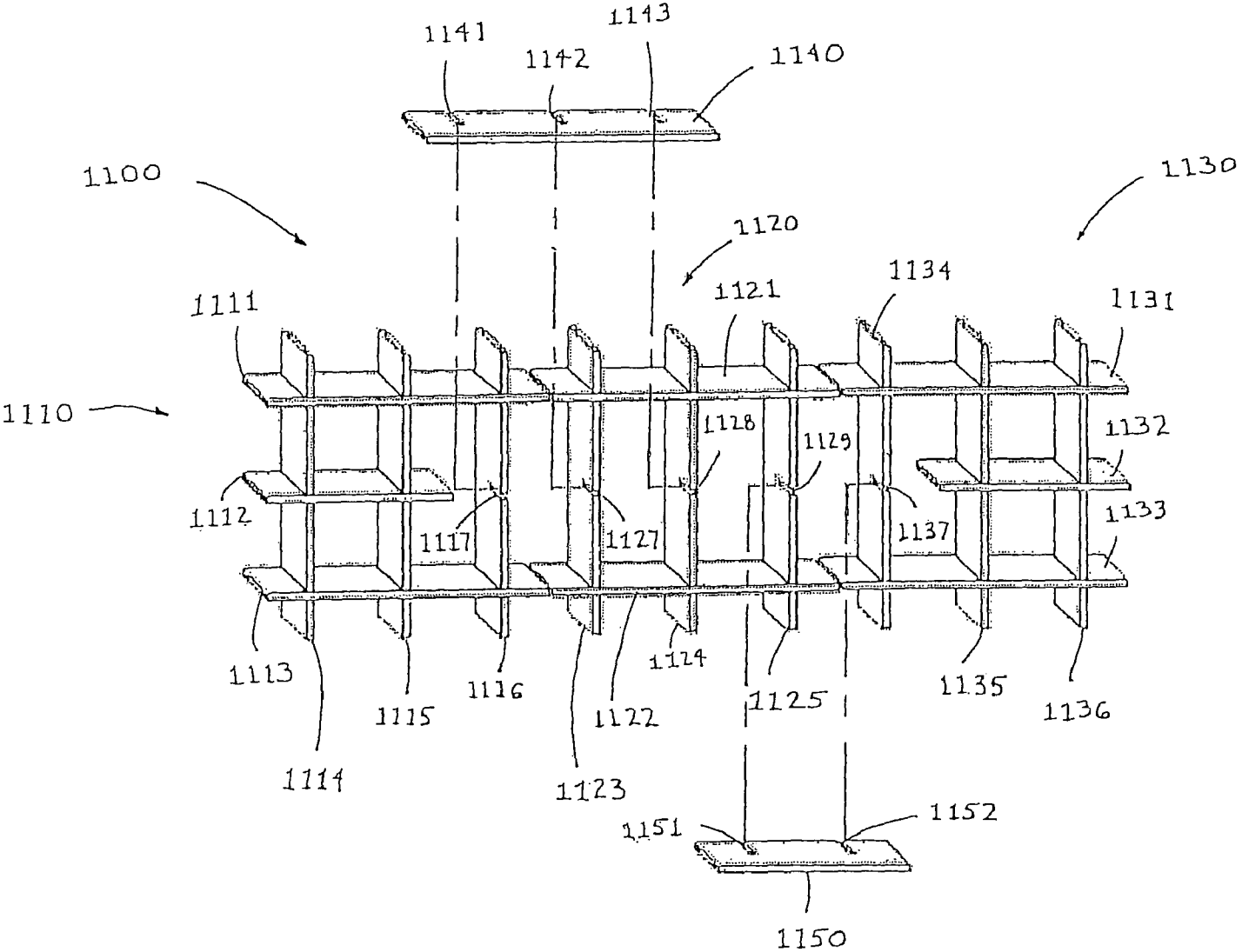
FIG. 11 depicts an exemplary assembled unit comprising three subassemblies of structural members, each having slots in a lengthwise side, and two connecting members, each having slots in a lengthwise side.

FIG. 11 depicts assembled unit 1100 comprising three subassemblies and two connecting members. First subassembly 1110 includes structural members 1111, 1112, 1113, 1114, 1115 and 1116. Second subassembly 1120 includes structural members 1121, 1122, 1123, 1124, and 1125. Third subassembly 1130 includes structural members 1131, 1132, 1133, 1134, 1135, and 1136. The structural members of each of the three subassemblies are detachably connected slot-to-slot to produce the three individual subassemblies. First subassembly 1110 and second subassembly 1120 are detachably connected slot-to-slot by connecting member 1140. More particularly, slot 1141 on connecting member 1140 is connected to slot 1117 on first subassembly structural member 1116, slot 1142 on connecting member 1140 is connected to slot 1127 on second subassembly structural member 1123, and slot 1143 on connecting member 1140 is connected to slot 1128 on second subassembly structural member 1124. Second subassembly 1120 and third subassembly 1130 are detachably connected slot-to-slot by connecting member 1150. More particularly, slot 1151 on connecting member 1150 is connected to slot 1129 on second subassembly structural member 1125, and slot 1152 on connecting member 1150 is connected to slot 1137 on third subassembly structural member 1134. The assembled unit depicted by FIG. 11, like the assembled units of FIGS. 9, 9*a*, 9*b*, and 10, is merely one example of the variety of subassemblies and connecting members that may be used to produce an assembled unit according to the system of the invention. Further, while FIGS. 9 through 10 show subassemblies being connected in a horizontal orientation, it is contemplated within the scope of the invention that subassemblies like those depicted in FIGS. 9 through 10 may be connected in a vertical orientation to produce assembled units.

Figure 11A:
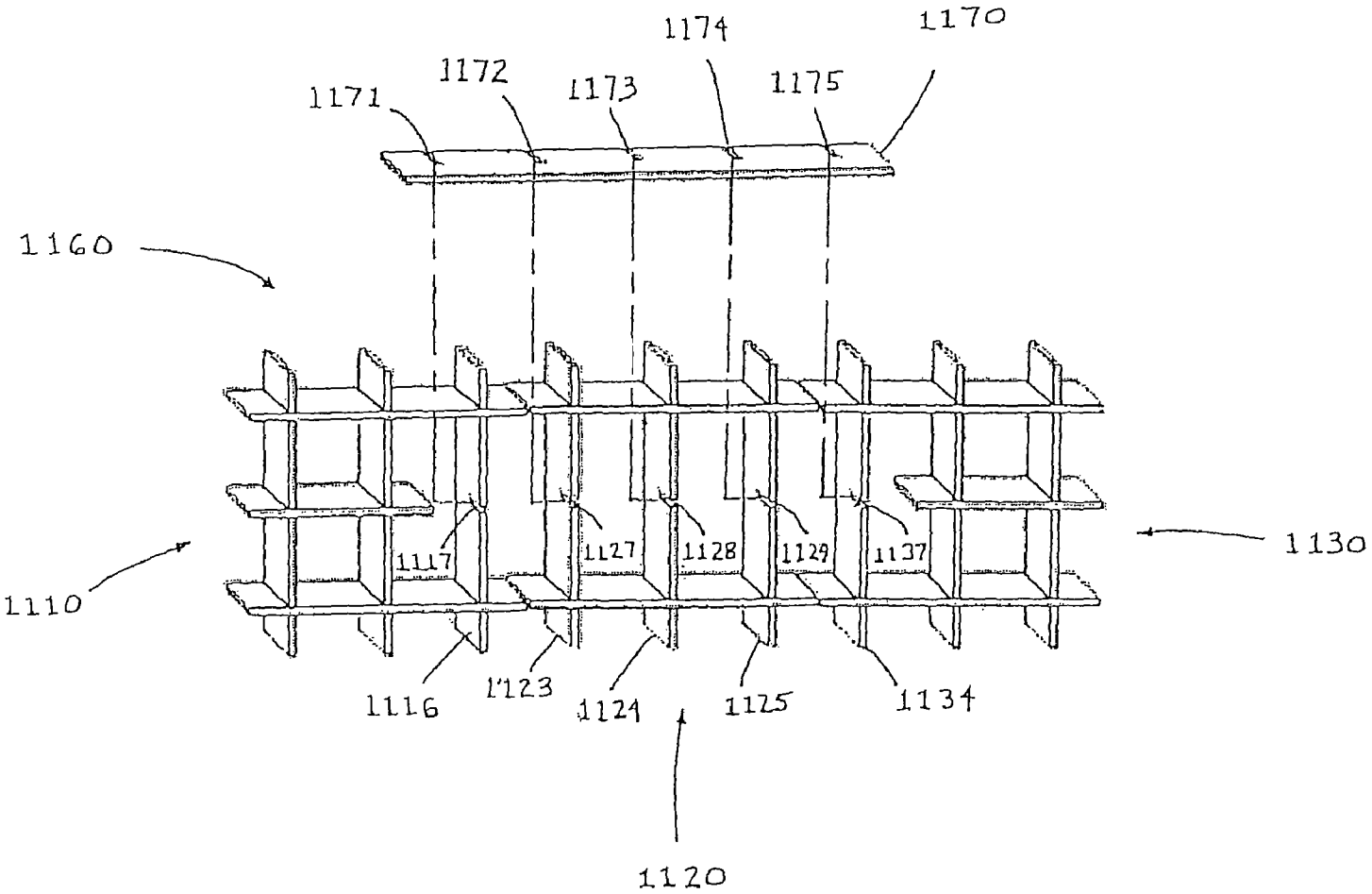
FIG. 11*a* depicts an exemplary assembled unit comprising three subassemblies of structural members, each having slots in a lengthwise side, and one connecting member having slots in a lengthwise side.

Referring now to FIG. 11*a*, assembled unit 1160 comprises three subassemblies and one connecting member. More particularly, assembled unit 1160 comprises first subassembly 1110, second subassembly 1120, and third subassembly 1130, as described above. In addition, assembled unit 1160 includes connecting member 1170 having five slots 1171, 1172, 1173, 1174, and 1175 in a lengthwise side. Slot 1171 is connected to slot 1117 on first subassembly structural member 1116, slot 1172 is connected to slot 1127 on second subassembly structural member 1123, slot 1173 is connected to slot 1128 on second subassembly structural member 1124, slot 1174 is connected to slot 1129 on second subassembly structural member 1125, and slot 1175 is connected to slot 1137 on third subassembly structural member 1134. It is contemplated within the scope of the invention that more or less than three subassemblies may be detachably connected slot-to-slot by one connecting member.

Figure 12:
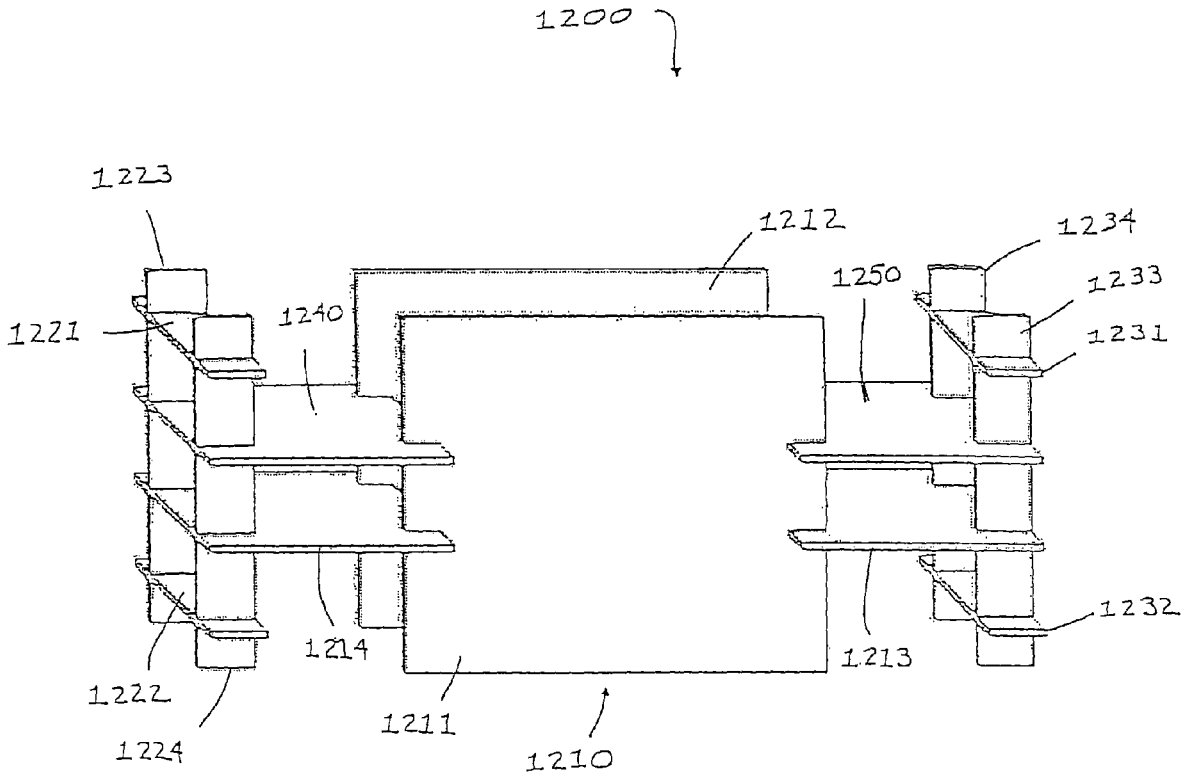
FIG. 12 depicts an exemplary assembled unit comprising two subassemblies of structural members, each having slots in a lengthwise side, one subassembly of structural members having slots in each widthwise side, and two connecting members, each having slots in each widthwise side.

FIG. 12 depicts another example of an assembled unit constructed according to the system of the invention. Assembled unit 1200 comprises three subassemblies and two connecting members. More particularly, assembled unit 1200 comprises first subassembly 1210 including four structural members 1211, 1212, 1213, and 1214. Each of the four structural members of the first subassembly are connected slot-to-slot by slots on the widthwise sides of the structural members. Second subassembly 1220 and third subassembly 1230 each include four structural members that are connected slot-to-slot by slots on a lengthwise side of the structural members. The second subassembly includes structural members 1221, 1222, 1223, and 1224. The third subassembly includes structural members 1231, 1232, 1233, and 1234.

The assembled unit further comprises connecting members 1240 and 1250, each having a pair of connecting member slots in each of the widthwise sides. As illustrated in FIG. 12, the pair of connecting member slots in one widthwise side of connecting member 1240 are detachably connected slot-to-slot with a slot on second subassembly structural member 1223 and a slot on second subassembly structural member 1224. The pair of connecting member slots on the other widthwise side of connecting member 1240 are detachably connected slot-to-slot with a slot on first subassembly structural member 1211 and a slot on first subassembly structural member 1212. The pair of connecting member slots in one widthwise side of connecting member 1250 are detachably connected slot-to-slot with a slot on third subassembly structural member 1233 and a slot on third subassembly structural member 1234. The pair of connecting member slots on the other widthwise side of connecting member 1250 are detachably connected slot-to-slot with a slot on first subassembly structural member 1211 and a slot on first subassembly structural member 1212.

By maintaining the spacing of the slots on a structural member according to the standardized spacing model described above, several advantages are realized. First, the standardized spacing model of the preferred system provides the system with "scalability." Scalability is the ability to duplicate, or replicate ad infinitum, smaller assemblies of structural members (subassemblies) to produce a larger assembled unit. The standardized spacing model allows the assembled unit produced by connecting a plurality of subassemblies to maintain the same spaced relationship between the structural members as existed before the plurality of subassemblies were connected. In other words, the standardized spacing model permits the formation of several different subassemblies to be produced, each such subassembly being produced by a plurality of structural members and having a spaced relationship between the structural members which defines the look or proportionality of the subassembly. Then the standardized spacing model allows the different subassemblies to be connected without altering the spaced relationship between the structural members of the individual subassemblies. Consequently, the "look" or proportionality of a subassembly may be maintained even after the subassembly is incorporated into a larger assembled unit.

The "scalability" of the Applicant's invention overcomes several disadvantages the prior art. For example, the overall dimensions of an assembled unit of the Applicant's invention may exceed the length or width of its largest individual structural member. The "scalability" of the subassemblies of Applicant's invention allows the user to create customized, aesthetically-pleasing structures of small or large proportions and horizontal or vertical dispositions. Further, the dimensions of the assembled unit of the Applicant's invention may be longer and/or wider than the length or width of the longest or widest individual structural member. Still further, the dimensions of the assembled unit of the Applicant's invention may be longer and/or wider than the length or width of the longest or widest dimension of a subassembly of structural members.

The standardized spacing model of the structural members of the system provides another advantage. The subassemblies of the system may detachably connected such that the locations where the connections are made are staggered or non-planar. More particularly, the system provides that a subassembly of structural members may be detachably connected to other subassemblies such that the abutting sides of coplanar structural members are not aligned along a vertical or horizontal plane. In other words, the subassemblies may be detachably connected to each other in a "brick-and-mortar" style construction. As a result, an assembled unit with greater structural stability than conventional systems is produced. In addition, the "brick and mortar" style construction minimizes or eliminates the need for additional fasteners on the structural members.

Figure 13:
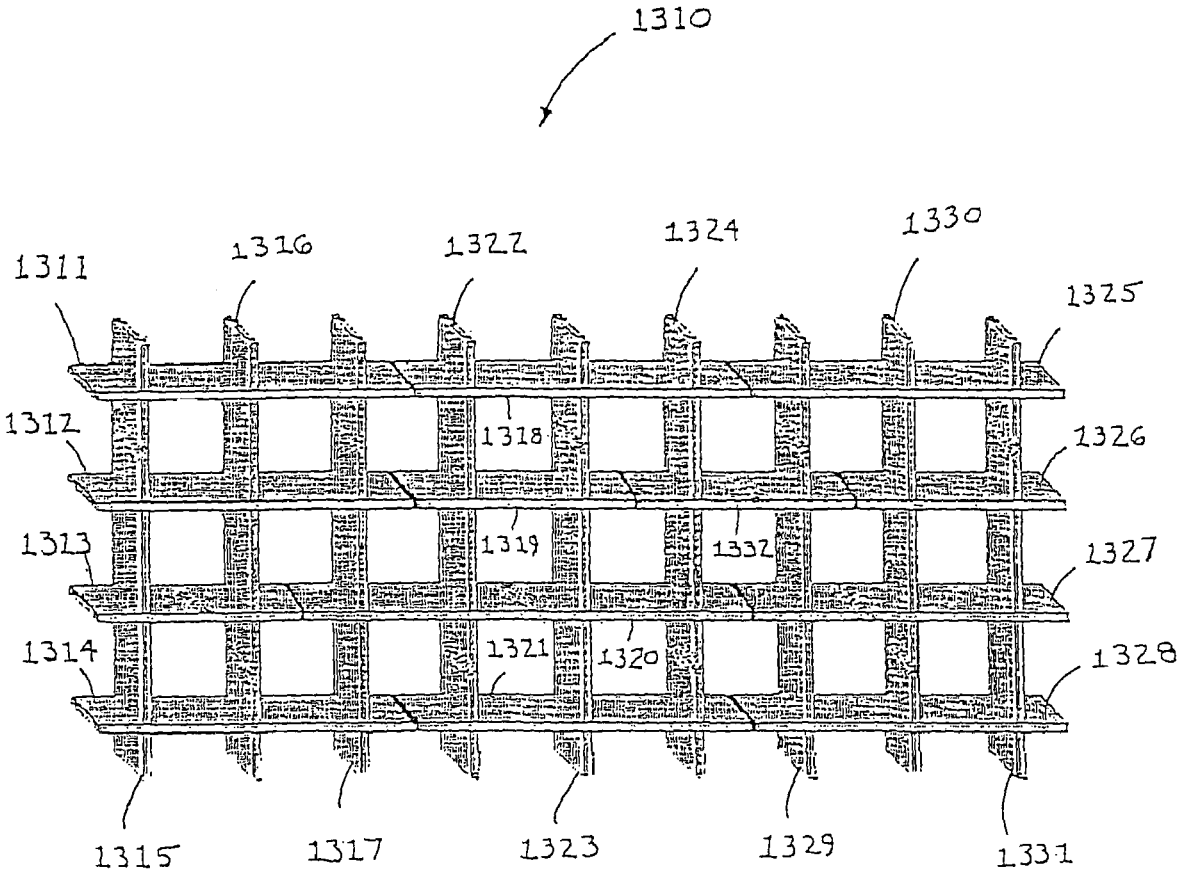
FIG. 13 depicts an exemplary assembled unit comprising a plurality of subassemblies of structural members, each having slots in a lengthwise side, and a plurality of connecting members, each having at least two slots in a lengthwise side.

By way of illustration, the structural members of the invention may be connected to produce subassemblies that may be connected to produce an assembled unit as shown in FIG. 13. As illustrated in FIG. 13, the Applicant's system allows for connections between abutting coplanar structural members of different subassemblies (illustrated by solid lines parallel to the widthwise sides of the structural members) to be made in non-planar or staggered locations. In other words, the Applicant's system does not require the side-by-side or vertical stacking of subassemblies in order to "scale" the subassemblies into an assembled unit. Instead, the apparatus of the Applicant's invention allows for the larger assembled unit, such as unit 1310, to be made up of a plurality of smaller subassemblies that are interconnected at staggered or non-planar locations so as to improve the structural integrity of the larger assembled unit. As a result, the system of the Applicant's invention may be assembled without the use of fastening devices like dowels, threaded fasteners or the like. Of course, it is contemplated within the scope of the invention that suitable conventional fastening devices such as threaded fasteners, brackets, dowels and dowel holes, adhesives, snaps, interlocking grooves or channels, magnets and the like may be used in connection with the present invention in order to reinforce or strengthen the connection between structural members. Moreover, the system of the Applicant's invention provides a greater degree of structural integrity than a conventional side-by-side or vertically-stacked modular system.

Referring to FIG. 13, assembled unit 1310 includes a first subassembly, a second subassembly, a third subassembly, and two connecting members. More particularly, the first subassembly comprises structural members 1311, 1312, 1313 1314, 1315, 1316 and 1317. The second subassembly comprises structural members 1318, 1319, 1321, 1322, 1323, and 1324. The first subassembly is detachably connected slot-to-slot to the second subassembly using connecting member 1320. The third subassembly comprises structural members 1325, 1326, 1327, 1328, 1329, 1330, and 1331. The second subassembly is detachably connected slot-to-slot to the third subassembly using connecting member 1332. It is understood that assembled unit 1310 is merely an example of an assembled unit comprising a plurality of subassemblies detachably connected slot-to-slot by one or more connecting members. It is further understood that assembled unit 1310 illustrates only one of the plurality of ways in which a plurality of subassemblies may be detachably connected slot-to-slot by one or more connecting members such that the abutting ends of coplanar structural members from different subassemblies do not all align along a common plane.

The standardized spacing model of the system provides yet another advantage. The standardized spacing model allows for the replaceability and interchangeability of the structural members within a subassembly or an assembled unit. More particularly, the standardized spacing model permits the replacement of like structural members with unlike structural members without altering the fixed spaced relationship between the structural members of the individual subassemblies or the assembled unit. For example, one structural member may be used to replace two or more different structural members while maintaining the same spaced relationship between the different structural members. Conversely, more than one structural member may be used to replace one different structural member while maintaining the spaced relationship between the different structural members. The replaceability and interchangeability of the structural members of the Applicant's invention provides the user with a convenient, inexpensive way to repair, maintain, and "scale" the structure. In addition, the replaceability and interchangeability of the structural members allows the user to maximize the structural integrity of the system as it is "scaled."

By way of illustration, the structural member illustrated in FIG. 4*d* may be removed from a subassembly or an assembled unit in which it is a component and replaced by the two structural members illustrated in FIGS. 4*a* and 4*c*. Conversely, a subassembly or an assembled unit including the two structural members illustrated in FIGS. 4*a* and 4*c* (in substantially coplanar and adjacent disposition with respect to each other) may be removed and replaced by the structural member illustrated in FIG. 4*d*. Additionally, the "scaling" process may be facilitated by replacing one shorter structural member such as illustrated by FIG. 4*b* with a longer member such as illustrated by FIG. 4*d*. Moreover, each of these changes to the system of the Applicant's invention may be made while maintaining the spaced relationship between the different structural members and while maintaining the structural integrity of the structure. Of course, the Applicant's invention also permits the removal of the any one of its structural members and the replacement thereof with another like member without altering the fixed spaced relationship between the structural members of an individual subassembly or an assembled unit.

Figure 14:
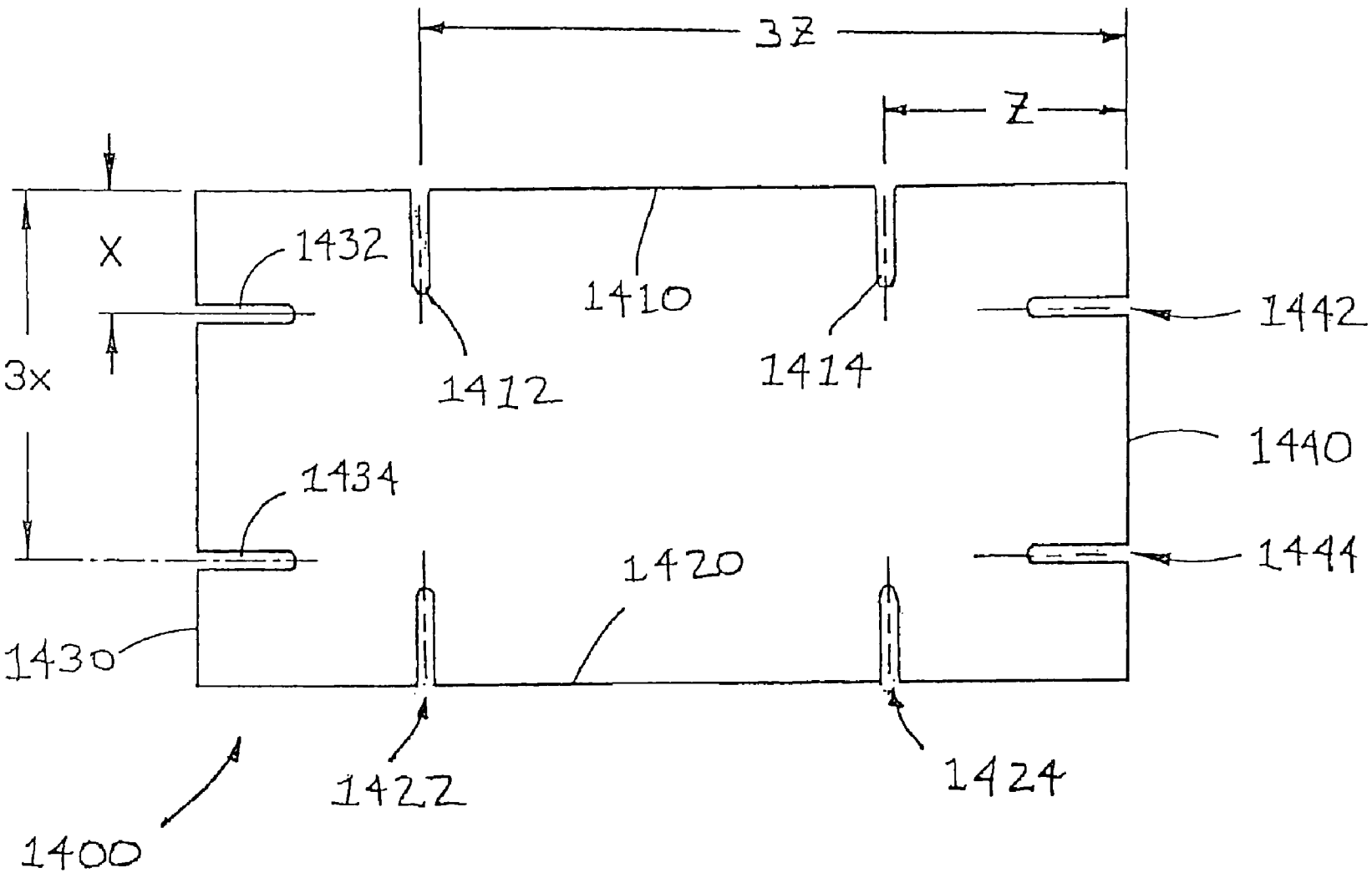
FIG. 14 depicts a representative structural member having a pair of slots in each lengthwise side and a pair of slots in each widthwise side in accordance with the present invention.

Referring now to FIG. 14, a representative structural member having a pair of slots along each lengthwise side and a pair of slots along each widthwise side is illustrated. More particularly, as shown in FIG. 14, the preferred structural member 1400 includes first lengthwise side 1410, second lengthwise side 1420, first widthwise side 1430 and second widthwise side 1440. The preferred first lengthwise side 1410 includes first lengthwise side first outside slot 1412 and first lengthwise side second outside slot 1414. The preferred first lengthwise side first outside slot 1412 includes first lengthwise side first outside slot axis 1416, and the preferred first lengthwise side second outside slot 1414 includes first lengthwise side second outside slot axis 1418. The distance between first lengthwise side first outside slot axis 1416 and first widthwise side 1430 is a predetermined slot-to-side distance designated by "X". The distance between first lengthwise side second outside slot axis 1418 and second widthwise side 1440 is equal to the predetermined slot-to-side distance "X". The distance between first lengthwise side first outside slot axis 1416 and first lengthwise side second outside slot axis 1418, i.e. the slot-to-slot distance, is a whole number multiple of the predetermined slot-to-side distance "X", i.e. 2X.

Still referring to FIG. 14, the preferred second lengthwise side 1420 includes second lengthwise side first outside slot 1422 and second lengthwise side second outside slot 1424. The preferred second lengthwise side first outside slot 1422 includes second lengthwise side first outside slot axis 1426, and the preferred second lengthwise side second outside slot 1424 includes second lengthwise side second outside slot axis

1428. The distance between second lengthwise side first outside slot axis 1426 and first widthwise side 1430 is the predetermined slot-to-side distance designated by "X". The distance between second lengthwise side second outside slot axis 1418 and second widthwise side 1440 is equal to the predetermined slot-to-side distance "X". The distance between second lengthwise side first outside slot axis 1426 and second lengthwise side second outside slot axis 1428, i.e. the slot-to-slot distance, is a whole number multiple of the predetermined slot-to-side distance "X", i.e. 2X.

The preferred first widthwise side 1430 includes first widthwise side first outside slot 1432 and first widthwise side second outside slot 1434. The preferred first widthwise side first outside slot 1432 includes first widthwise side first outside slot axis 1436, and the preferred first widthwise side second outside slot 1434 includes first widthwise side second outside slot axis 1438. The distance between first widthwise side first outside slot axis 1436 and first lengthwise side 1410 is the predetermined slot-to-side distance designated by "X". The distance between first widthwise side second outside slot axis 1438 and second lengthwise side 1420 is equal to the predetermined slot-to-side distance "X". The distance between first widthwise side first outside slot axis 1436 and first widthwise side second outside slot axis 1438, i.e. the slot-to-slot distance, is a whole number multiple of the predetermined slot-to-side distance "X", i.e. 1X.

The preferred second widthwise side 1440 includes second widthwise side first outside slot 1442 and second widthwise side second outside slot 1444. The preferred second widthwise side first outside slot 1442 includes second widthwise side first outside slot axis 1446, and the preferred second widthwise side second outside slot 1444 includes second widthwise side second outside slot axis 1448. The distance between second widthwise side first outside slot axis 1446 and first lengthwise side 1410 is the predetermined slot-to-side distance designated by "X". The distance between second widthwise side second outside slot axis 1448 and second lengthwise side 1420 is equal to the predetermined slot-to-side distance "X". The distance between second widthwise side first outside slot axis 1446 and second widthwise side second outside slot axis 1448, i.e. the slot-to-slot distance, is a whole number multiple of the predetermined slot-to-side distance "X", i.e. 1X.

Figure 15B:
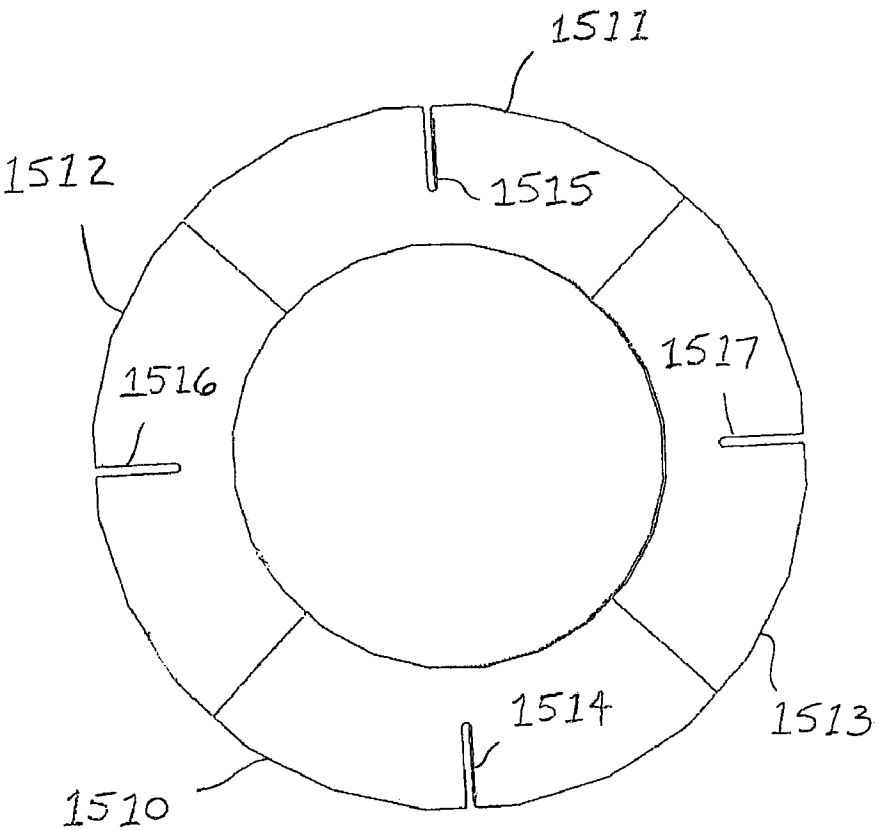
FIG. 15B depicts four preferred arcuate support structures arranged as an exemplary ring-shaped support structure in accordance with the present invention.
Figure 15A:
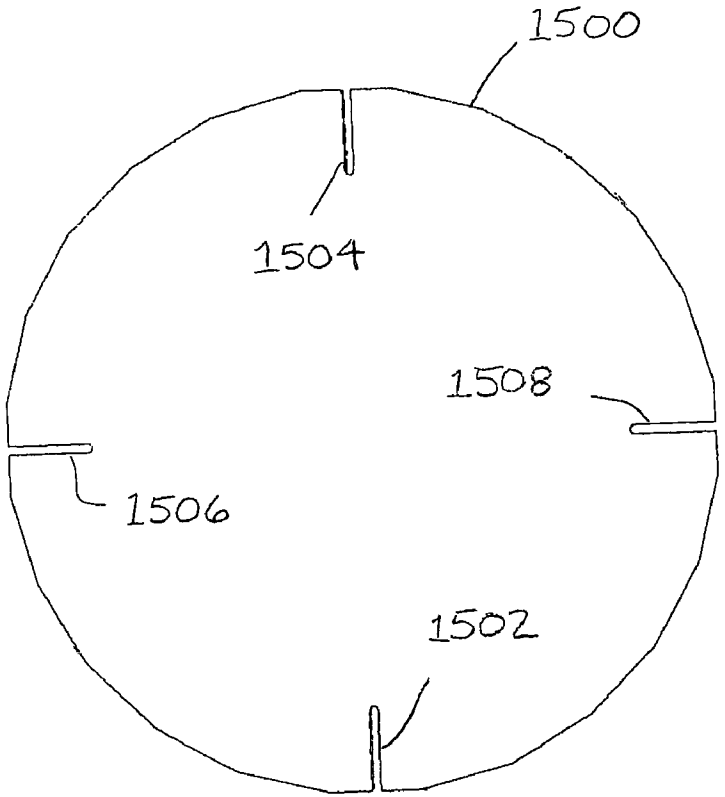
FIG. 15A depicts an exemplary circular support structure in accordance with the present invention.

Referring now to FIG. 15A, a circular support structure designated generally by reference numeral 1500 is illustrated. As shown in FIG. 15A, preferred circular support structure 1500 is substantially circular in configuration and includes a plurality of slots 1502, 1504, 1506 and 1508 disposed along the perimeter of the support structure. While FIG. 15A illustrates a circular support structure having four slots disposed along the perimeter of the support structure, it is contemplated within the scope of the invention that more or less than four slots may be disposed along the perimeter of the support structure. It is also contemplated within the scope of the invention that the slots disposed along the perimeter of the support structure may be disposed at locations other than 90° apart from each other.

Referring now to FIG. 15B, four arcuate support structures designated generally by reference numerals 1510, 1511, 1512 and 1513 are illustrated. As shown in FIG. 15B, each of the preferred arcuate support structures includes a slot 1514, 1515, 1516 and 1517, respectively, disposed along the perimeter of the support structure. While FIG. 15B illustrates four arcuate support structures forming a ring-shaped support structure, it is contemplated within the scope of the invention that more or less than four arcuate support structures may be used to form a ring-shaped support structure. It is also contemplated that arcuate structures such as those illustrated in FIG. 15B may be arranged to form configurations other than ring-shaped support structures. For example, and without limitation, the arcuate support structures shown in FIG. 15B may be arranged to form semi-circular support structures, "S"-shaped support structures, wave-shaped support structures and the like. In addition, while FIG. 15B illustrates arcuate support structures each having one slot disposed along one side of the support structure, it is contemplated within the scope of the invention that more or less than one slot may be disposed along one side of the support structure and that one or more slots may be disposed along more than one side of the support structure. It is also contemplated within the scope of the invention that the slot disposed along the side of the support structure may be disposed at locations other than an equal distance from the ends of the support structure.

Figure 15C:
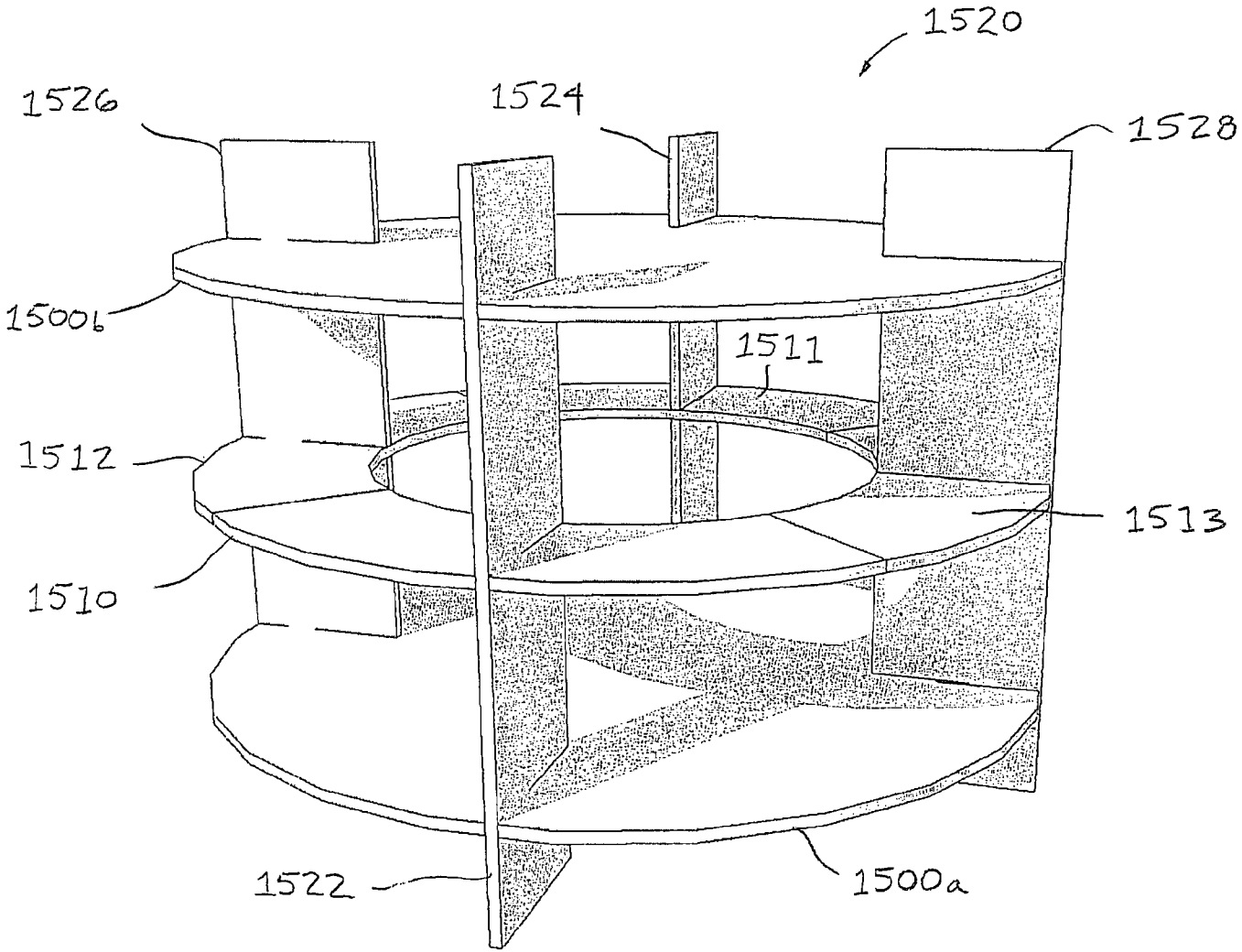
FIG. 15C is a perspective view of a preferred assembled unit comprising the support structures illustrated in FIGS. 15A and 15B in accordance with the present invention.

Referring now to FIG. 15C, an assembled unit incorporating the support structures shown in FIGS. 15A and 15B is illustrated. More particularly, the preferred assembled unit 1520 includes a pair of circular support structures 1500*a* and 1500*b* and four arcuate support structures 1510, 1511, 1512 and 1513. In addition, preferred assembled unit 1520 includes four vertically-disposed structural members 1522, 1524, 1526 and 1528. The preferred vertically-disposed structural members 1522, 1524, 1526 and 1528 are structural members having the same unique spaced relationship between the predetermined slot-to-side distance and the slot-to-slot distance describe herein. More particularly, each of the preferred vertically-disposed structural members 1522, 1524, 1526 and 1528 has a predetermined slot-to-side distance, which is the distance from an end of the structural member to the central axis of the slot nearest to that end of the structural member. Each of the preferred vertically-disposed structural members 1522, 1524, 1526 and 1528 also has a slot-to-slot distance, which is the distance between the central axis of a slot to the central axis of an adjacent slot. The unique spaced relationship between the predetermined slot-to-side distance and the slot-to-slot distance is that the slot-to-slot distance is a whole number multiple of the predetermined slot-to-side distance.

As discussed above, it is contemplated within the scope of the invention that a vertically-disposed structural member may have two different predetermined slot-to-side distances, provided that the second predetermined slot-to-side distance is a whole-number multiple of the first predetermined slot-to-side distance. It is further contemplated within the scope of the invention that a vertically-disposed structural member may have two or more different slot-to-slot distances, provided that each of the slot-to-side distances is a whole-number multiple of the first predetermined slot-to-side distance. Notwithstanding the foregoing, each preferred vertically-disposed structural member embodies the same unique spaced relationship between the predetermined slot-to-side distance (s) and the slot-to-slot distance(s) described herein. It is further contemplated within the scope of the invention that an assembled unit may comprise only three vertically-disposed structural members detachably connected slot-to-slot to one or more horizontally-disposed circular support structures and/or arcuate support structures.

Figure 16:
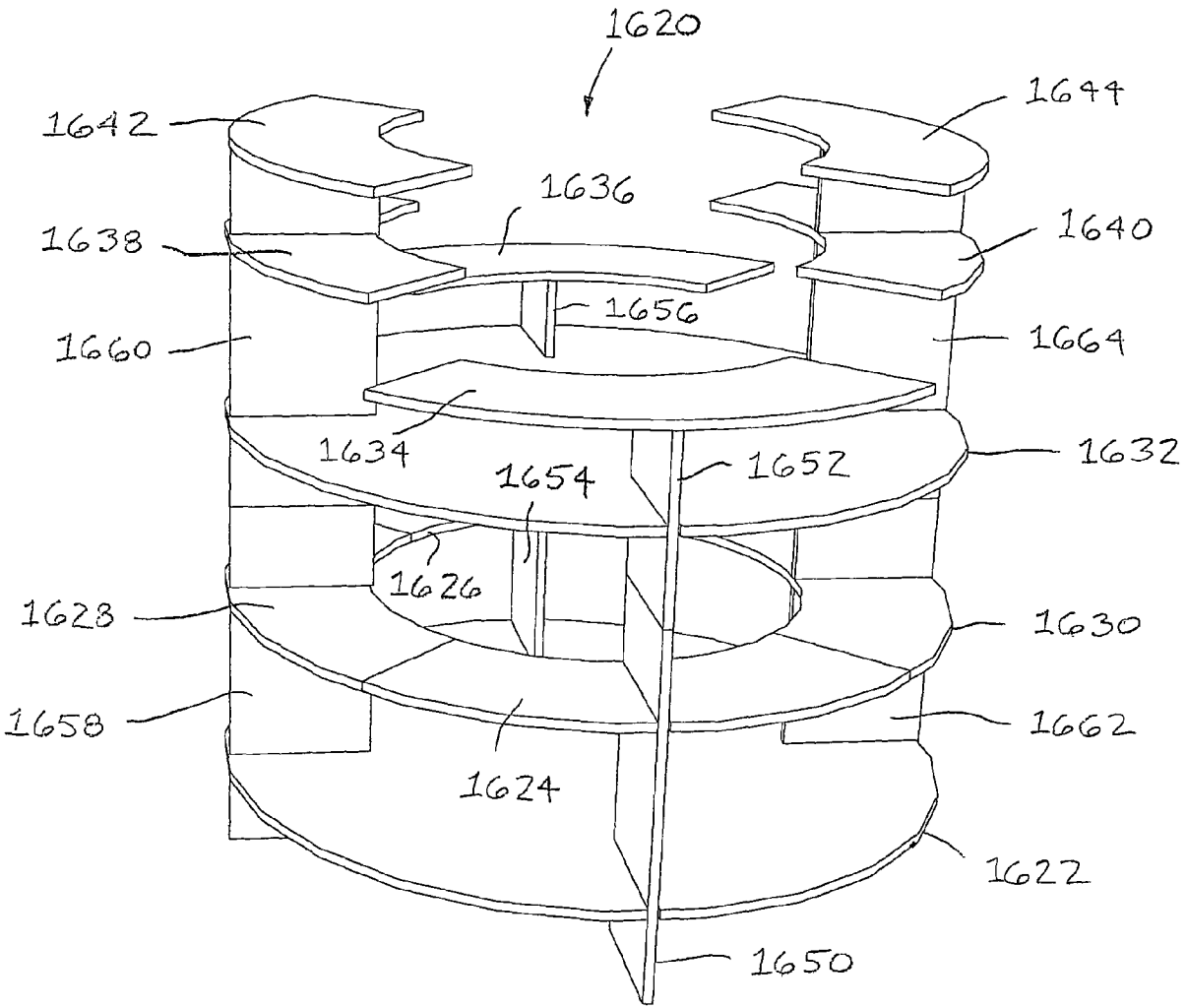
FIG. 16 is a perspective view of an alternative embodiment of an assembled unit comprising the support structures illustrated in FIGS. 15A and 15B in accordance with the present invention.

Referring now to FIG. 16, a perspective view of a preferred assembled unit in accordance with the present invention is illustrated. More particularly, preferred assembled unit 1620 comprises first circular support structure 1622, first arcuate support structure 1624, second arcuate support structure 1626, third arcuate support structure 1628, fourth arcuate support structure 1630, second circular support structure 1632, fifth arcuate support structure 1634, sixth arcuate support structure 1636, seventh arcuate support structure 1638, eighth arcuate support structure 1640, ninth arcuate support structure 1642 and tenth arcuate support structure 1644. As shown in FIG. 16, each of the support structures is supported by one or more vertically-disposed structural members. Indeed, each of the support structures (except for fifth arcuate support structure 1634, sixth arcuate support structure 1636, ninth arcuate support structure 1642 and tenth arcuate support structure 1644) is detachably connected slot-to-slot with a slot in a vertically-disposed structural member. Fifth arcuate support structure 1634, sixth arcuate support structure 1636, ninth arcuate support structure 1642 and tenth arcuate support structure 1644 may be attached to an end of a structural member by any conventional means such as a hole and peg combination.

Referring still to FIG. 16, the preferred structural member 1650 is a two-slot structural member in which one slot is detachably connected to a slot in first circular support structure 1622 and the other slot is detachably connected to first arcuate support structure 1624. The preferred second structural member 1652 is a one-slot structural member in which the slot is detachably connected to a slot in second circular support structure 1632. The preferred second structural member 1652 also supports fifth arcuate support structure 1634. The preferred fifth arcuate support structure 1634 may be attached to second structural member 1652 by any conventional means such as a hole and peg combination. Similarly, the preferred second structural member 1652 may be attached to first structural member 1650 by any conventional means such as a hole and peg combination. Further, because of the unique spaced relationship between the predetermined slot-to-side distance and the slot-to-slot distance, preferred first structural member 1650 and preferred second structural member 1652 may be removed from the assembled unit and replaced by a single three-slot structural member without changing the spaced relationships between the support structures.

Still referring to FIG. 16, the preferred third structural member 1654 and the preferred fourth structural member 1656 are vertically-disposed opposite from preferred first structural member 1650 and preferred second structural member 1652. In addition, preferred third structural member 1654 and the preferred fourth structural member 1656 are symmetrical to preferred first structural member 1650 and preferred second structural member 1652. Consequently, the description above relating to preferred first structural member 1650 and preferred second structural member 1652 applies equally to preferred third structural member 1654 and the preferred fourth structural member 1656. Of course, the preferred third structural member 1654 is detachably connected to preferred second arcuate support structure 1626, not preferred first arcuate support structure 1624, and preferred fourth structural member 1656 supports preferred sixth arcuate support structure 1636, not preferred fifth arcuate support structure 1634.

Referring still to FIG. 16, the preferred fifth structural member 1658 is a two-slot structural member in which one slot is detachably connected to a slot in first circular support structure 1622 and the other slot is detachably connected to third arcuate support structure 1628. The preferred sixth structural member 1660 is a two-slot structural member in which one slot is detachably connected to a slot in second circular support structure 1632 and the other slot is detachably connected to preferred seventh arcuate support structure 1638. The preferred sixth structural member 1660 also supports ninth arcuate support structure 1642. The preferred ninth arcuate support structure 1642 may be attached to sixth structural member 1660 by any conventional means such as a hole and peg combination. Similarly, the preferred sixth structural member 1660 may be attached to fifth structural member 1658 by any conventional means such as a hole and peg combination. Further, because of the unique spaced relationship between the predetermined slot-to-side distance and the slot-to-slot distance, preferred fifth structural member 1658 and preferred sixth structural member 1660 may be removed from the assembled unit and replaced by a single four-slot structural member or by a combination of a three-slot structural member and a one-slot structural member without changing the spaced relationships between the support structures. See also FIG. 17D.

Still referring to FIG. 16, the preferred seventh structural member 1662 and the preferred eighth structural member 1664 are vertically-disposed opposite from preferred fifth structural member 1658 and preferred sixth structural member 1660. In addition, preferred seventh structural member 1662 and the preferred eighth structural member 1664 are symmetrical to preferred fifth structural member 1658 and preferred sixth structural member 1660. Consequently, the description above relating to preferred fifth structural member 1658 and preferred sixth structural member 1660 applies equally to preferred seventh structural member 1662 and the preferred eighth structural member 1664. Of course, the preferred seventh structural member 1662 is detachably connected to preferred fourth arcuate support structure 1630, not preferred third arcuate support structure 1628, and preferred eight structural member 1664 is detachably connected to eighth support structure 1640, not seventh support structure 1638. Further, preferred eighth structural member 1664 supports preferred tenth-arcuate support structure 1644, not preferred ninth arcuate support structure 1642.

Figure 17A:
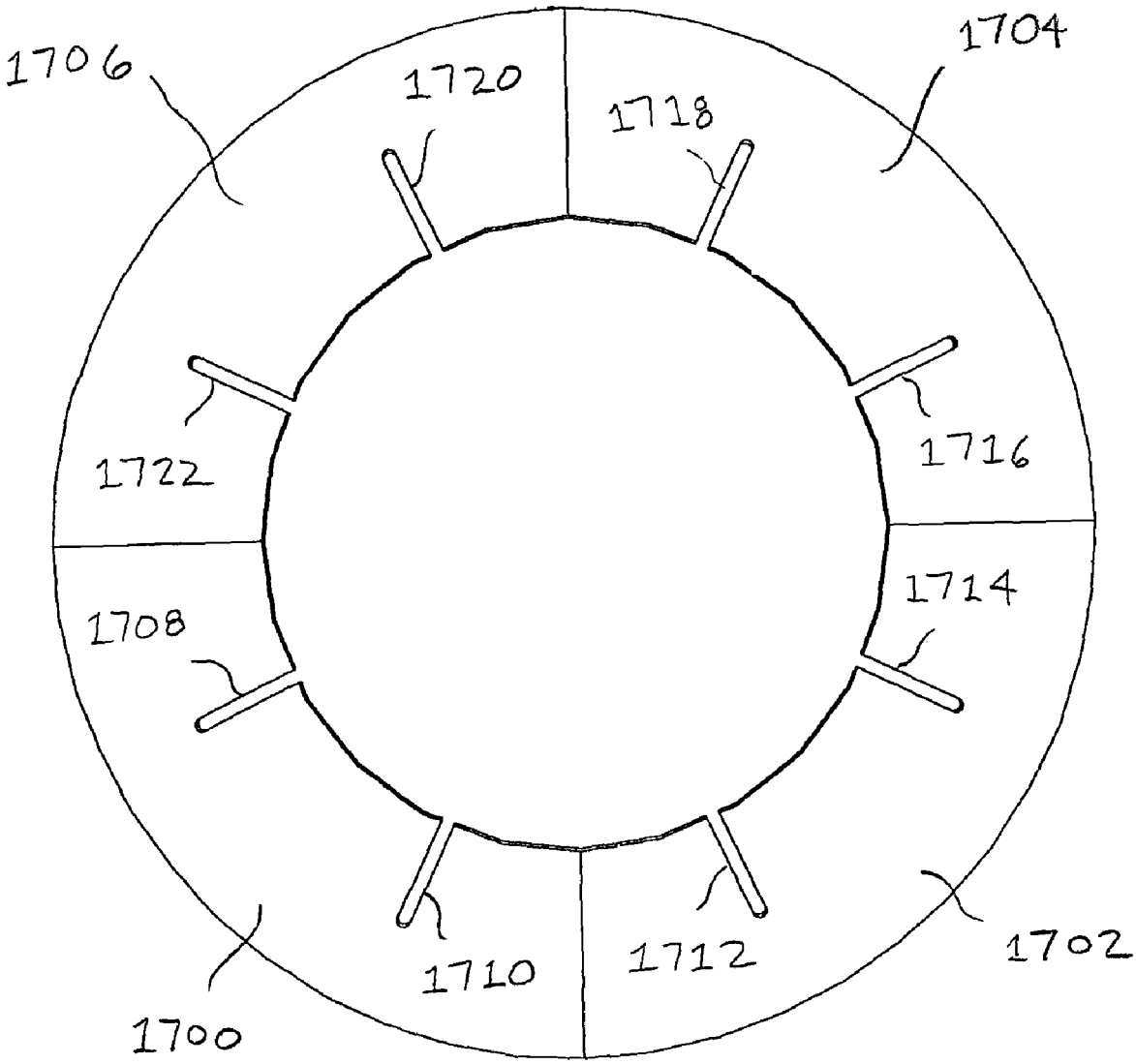
FIG. 17A depicts four preferred arcuate support structures arranged as an exemplary ring-shaped support structure in accordance with the present invention.

Referring now to FIG. 17A, four preferred arcuate support structures 1700, 1702, 1704 and 1706 arranged as an exemplary ring-shaped support structure in accordance with the present invention are illustrated. As shown in FIG. 17A, each of the four preferred arcuate support structures includes a pair of slots disposed along the inner curved side of the support structure. More particularly, preferred arcuate support structure 1700 includes slots 1708 and 1710, preferred arcuate support structure 1702 includes slots 1712 and 1714, preferred arcuate support structure 1704 includes slots 1716 and 1718, and preferred arcuate support structure 1706 includes slots 1720 and 1722. As shown in FIG. 17A, the slots (or slot) of the preferred arcuate support structures may be disposed on the inner side, i.e. the shorter lengthwise or curved side, of the support structure. In the alternative, as shown in FIG. 15B, the slot (or slots) of the preferred arcuate support structures may be disposed on the outer side, i.e. the longer lengthwise or curved side, of the support structure.

Still referring to FIG. 17A, the slots of the preferred arcuate support structures 1700, 1702, 1704 and 1706 are defined by the same unique spaced relationship of the structural members. More particularly, in each of the preferred arcuate support structures 1700, 1702, 1704 and 1706, there is a unique spaced relationship between the radial distance from the ends of the support structure to the nearest slot axis and the radial distance from a slot axis to the other slot axis or slot axes on the support structure. The radial distance from one end of the support structure to the nearest slot axis is the predetermined slot-to-side distance and the radial distance from a slot axis to the other slot axis or slot axes on the support structure is the slot-to-slot distance. The relationship between these two radial distances is that the slot-to-side distance is a whole-number multiple of the predetermined slot-to-side distance. In addition, the radial distance from the other end of the support structure to the nearest slot axis is a whole-number multiple of the predetermined slot-to-side distance.

While FIG. 17A illustrates four preferred arcuate support structures 1700, 1702, 1704 and 1706 each having a pair of slots, it is contemplated within the scope of the invention that each of the support structures may have more or fewer than two slots. It is also contemplated within the scope of the invention that one or more of the arcuate support structures may have a different number of slots than one or more other arcuate support structures.

Figure 17B:
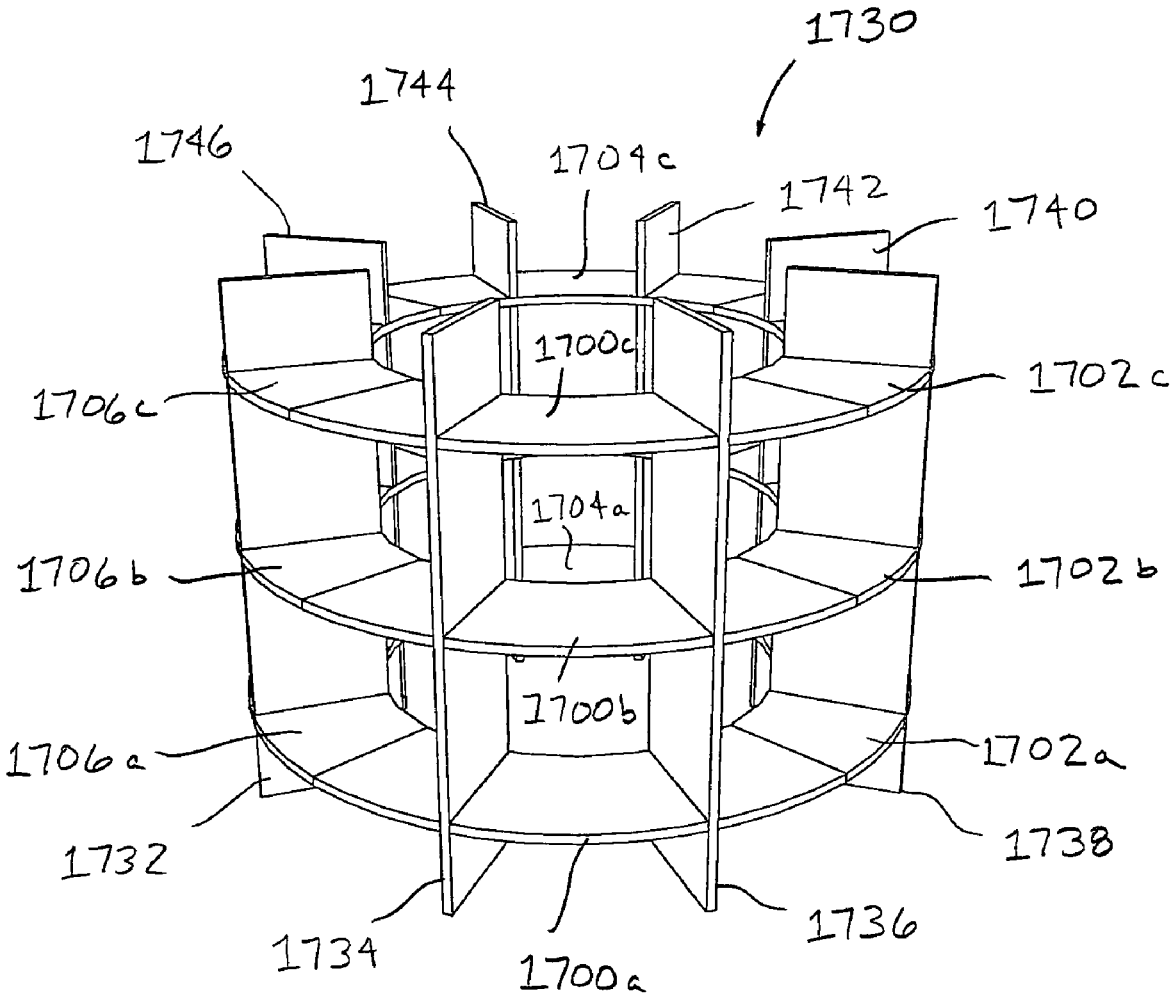
FIG. 17B is a perspective view of a preferred assembled unit comprising the support structures illustrated in FIG. 17A in accordance with the present invention.

FIG. 17B is a perspective view of a preferred assembled unit comprising the support structures illustrated in FIG. 17A in accordance with the present invention. More particularly, the preferred assembled unit 1730 includes preferred arcuate support structures 1700*a*, 1702*a*, 1704*a* and 1706*a*, preferred arcuate support structures 1700*b*, 1702*b*, 1704*b* and 1706*b* and preferred arcuate support structures 1700*c*, 1702*c*, 1704*c* and 1706*c*. In addition, preferred assembled unit 1730 includes vertically-disposed structural members 1732, 1734, 1736, 1738, 1740, 1742, 1744 and 1746. The preferred vertically-disposed structural members 1732, 1734, 1736, 1738, 1740, 1742, 1744 and 1746 are structural members having the same unique spaced relationship between the predetermined slot-to-side distance and the slot-to-slot distance describe herein. More particularly, each of the preferred vertically-disposed structural members 1732, 1734, 1736, 1738, 1740, 1742, 1744 and 1746 has a predetermined slot-to-side distance, which is the distance from an end of the structural member to the central axis of the slot nearest to that end of the structural member. Each of the preferred vertically-disposed structural members 1732, 1734, 1736, 1738, 1740, 1742, 1744 and 1746 also has a slot-to-slot distance, which is the distance between the central axis of a slot to the central axis of an adjacent slot. The unique spaced relationship between the predetermined slot-to-side distance and the slot-to-slot distance is that the slot-to-slot distance is a whole number multiple of the predetermined slot-to-side distance.

As discussed above, it is contemplated within the scope of the invention that a vertically-disposed structural member may have two different predetermined slot-to-side distances, provided that the second predetermined slot-to-side distance is a whole-number multiple of the first predetermined slot-to-side distance. It is further contemplated within the scope of the invention that a vertically-disposed structural member may have two or more different slot-to-slot distances, provided that each of the slot-to-side distances is a whole-number multiple of the first predetermined slot-to-side distance. Notwithstanding the foregoing, each preferred vertically-disposed structural member embodies the same unique spaced relationship between the predetermined slot-to-side distance (s) and the slot-to-slot distance(s) described herein. It is further contemplated within the scope of the invention that an assembled unit may comprise more or fewer than eight vertically-disposed structural members detachably connected slot-to-slot to one or more horizontally-disposed arcuate support structures.

Figure 17C:
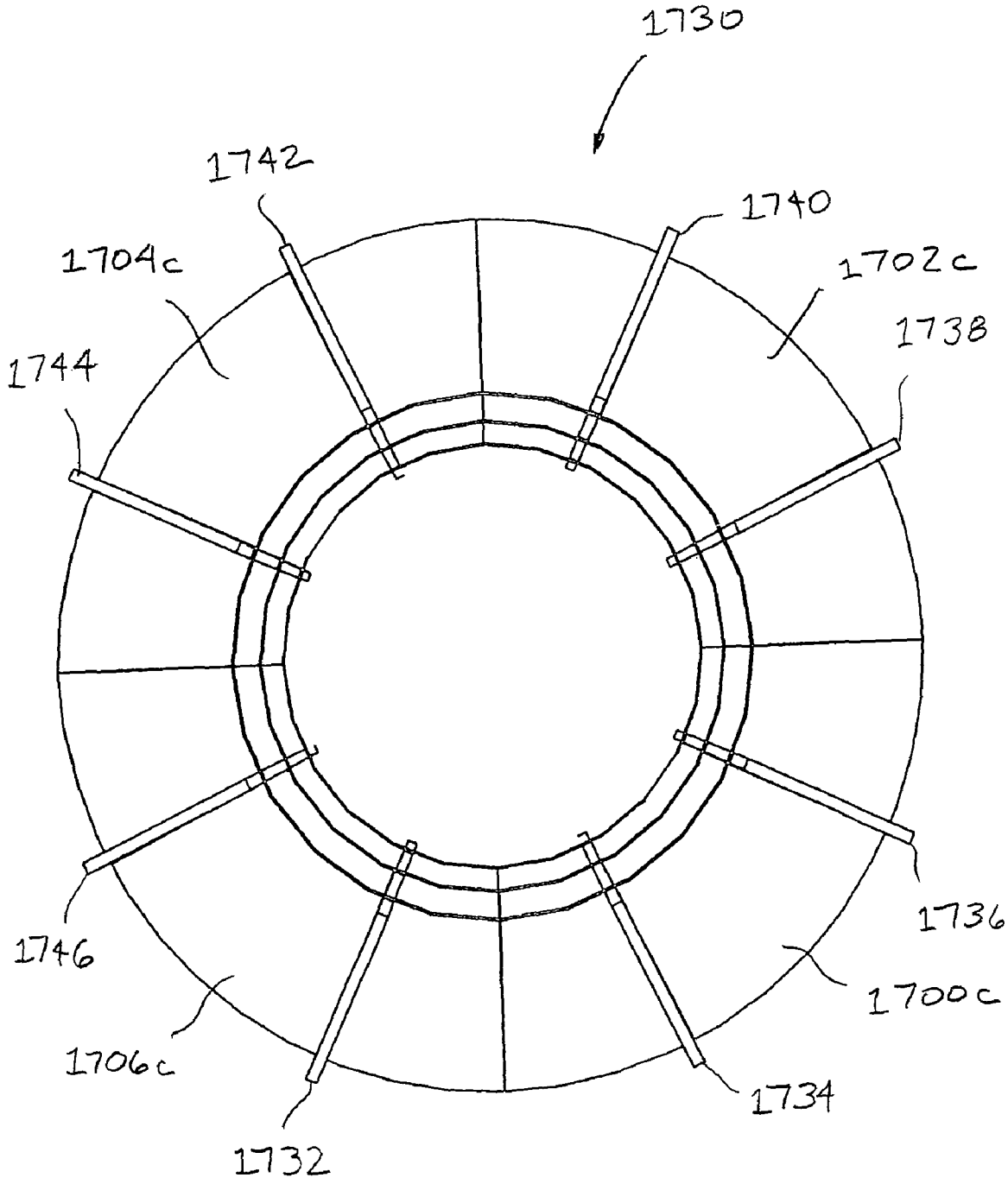
FIG. 17C is a top view of the preferred assembled unit illustrated in FIG. 17B.

Referring now to FIG. 17C, a top view of the preferred assembled unit shown in FIG. 17B is illustrated. As shown in FIG. 17C, the unique spaced relationship between the radial distance from the end of the preferred arcuate support structure to the nearest slot axis and the radial distance from a slot axis to the other slot axis or slot axes on the support structure allows arcuate support structure 1700*c* (a quarter-circle, two-slot component) and arcuate support structure 1702*c* (a quarter-circle, two-slot component) to be removed from the assembled unit and replaced by a semi-circular support structure having four slots without changing the spaced relationship between the other components of the assembled unit.

Figure 18:
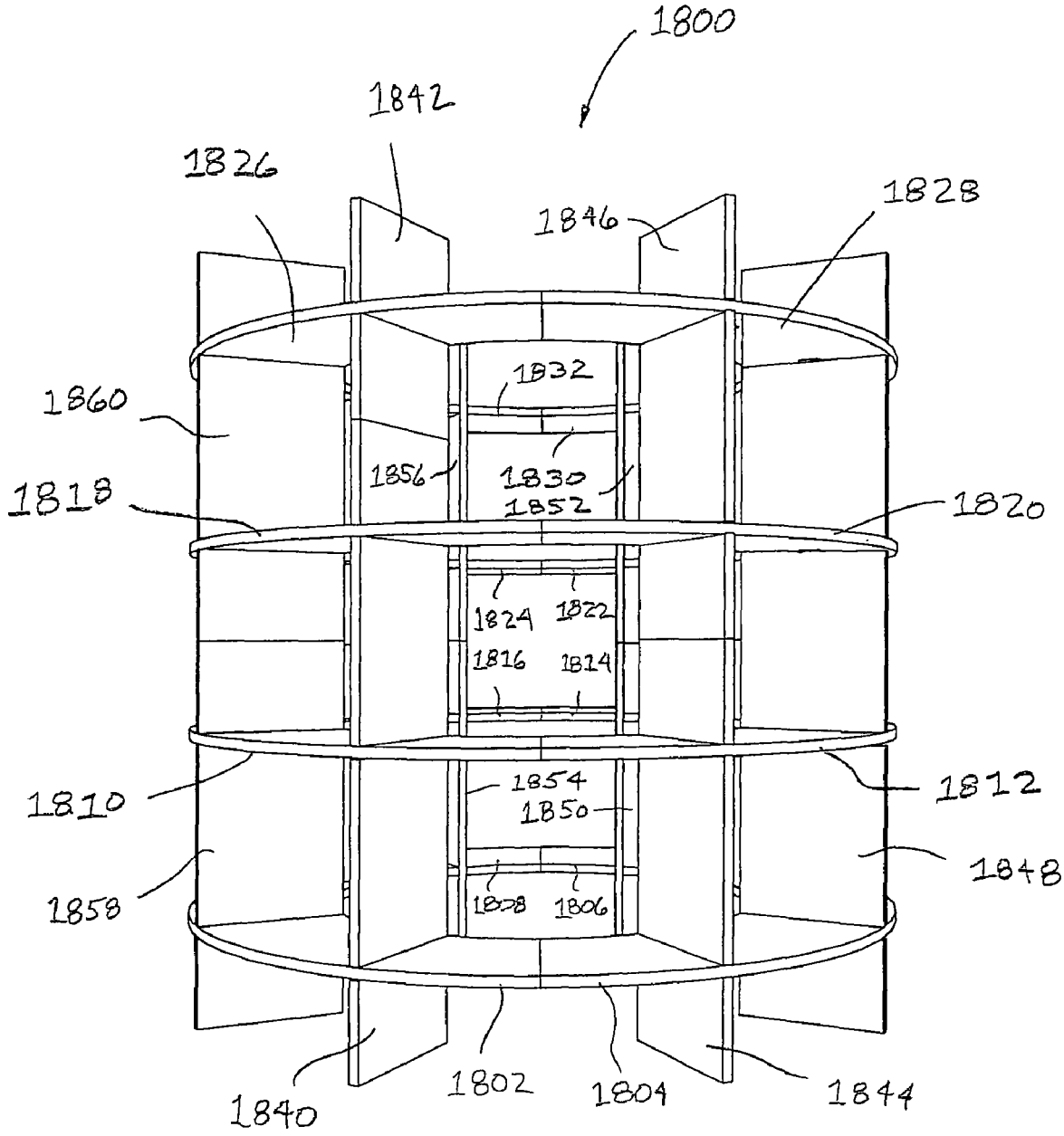
FIG. 18 is a perspective view of an alternative embodiment of an assembled unit comprising the support structures illustrated in FIG. 17A in accordance with the present invention.

Referring now to FIG. 18 a perspective view of an alternative embodiment of an assembled unit comprising the support structures illustrated in FIG. 17A in accordance with the present invention. As shown in FIG. 18, preferred assembled unit 1800 includes first arcuate support structure 1802, second arcuate support structure 1804, third arcuate support structure 1806, fourth arcuate support structure 1808, fifth arcuate support structure 1810, sixth arcuate support structure 1812, seventh arcuate support structure 1814, eighth arcuate support structure 1816, ninth arcuate support structure 1818, tenth arcuate support structure 1820, eleventh arcuate support structure 1822, twelfth arcuate support structure 1824, thirteenth arcuate support structure 1826, fourteenth arcuate support structure 1828, fifteenth arcuate support structure 1830 and sixteenth arcuate support structure 1832. The preferred assembled unit 1800 also includes first structural member 1840, second structural member 1842, third structural member 1844, fourth structural member 1846, fifth structural member 1848, sixth structural member 1850, seventh structural member 1852, eighth structural member 1854, ninth structural member 1856, tenth structural member 1858, eleventh structural member 1860, twelfth structural member 1862 (not shown), thirteenth structural member 1864 (not shown), fourteenth structural member 1866 (not shown) and fifteenth structural member 1868 (not shown).

As shown in FIG. 18, because of the unique spaced relationship between the predetermined slot-to-side distance and the slot-to-slot distance of the vertically-disposed structural members, preferred structural member 1842 (a one slot structural member) and preferred structural member 1840 (a three slot structural member) may be removed from the assembled unit and replaced by preferred structural member 1846 (a two slot structural member) and preferred structural member 1844 (a two slot structural member) without changing the spaced relationship between the components of the assembled unit. Similarly, either of the preceding pairs of structural members may be removed from the assembled unit and replaced by preferred structural member 1848 (a four slot structural member) without changing the spaced relationship between the components of the assembled unit.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A modular assembly system, said system comprising:

(A) a plurality of structural members, each of said plurality of structural members comprising:

(1) a first lengthwise side and a second lengthwise side opposite said first lengthwise side, each of said lengthwise sides being generally parallel to each other;

(2) a first widthwise side and a second widthwise side opposite said first widthwise side, each of said widthwise sides being generally parallel to each other;

(3) at least one slot along one of said lengthwise sides, each of said slots comprising:

(a) a pair of generally parallel slot sides;

(b) an open end along said one of said lengthwise sides;

(c) a slot axis parallel to and disposed equally between said slot sides;

wherein the distance between the slot axis of the slot nearest to the first widthwise side is a predetermined slot-to-side distance and the distance between the slot axis of the slot nearest to the second widthwise side is a whole-number multiple of the predetermined slot-to-side distance; and wherein the distance between each of the slot axes of the at least one slot along one of said lengthwise sides is a whole-number multiple of the predetermined slot-to-side distance; and (B) a circular support structure, said circular support structure having at least one slot disposed along the perimeter of the circular support structure and adapted to be detachably and selectively connected slot-to-slot to one of all of the at least one slot along one of said lengthwise sides of each of the plurality of structural members; and wherein said plurality of structural members comprises a first vertically-disposed structural member, a second vertically-disposed structural member and a third vertically-disposed structural member; and wherein one of the at least one slot along one of said lengthwise sides of the first vertically-disposed structural member is detachably connected slot-to-slot to one of the at least one slot disposed along the perimeter of the circular support structure, one of the at least one slot along one of said lengthwise sides of the second vertically-disposed structural member is detachably connected slot-to-slot to one of the at least one slot disposed along the perimeter of the circular support structure, and one of the at least one slot along one of said lengthwise sides of the third vertically-disposed structural member is detachably connected slot-to-slot to one of the at least one slot disposed along the perimeter of the circular support structure.

2. The modular assembly system of claim 1 wherein the first vertically-disposed structural member, the second vertically-disposed structural member and the third vertically-disposed structural member are substantially perpendicular to the circular support structure when the structural members are connected slot-to-slot to the circular support structure.

3. The modular assembly system of claim 1 wherein the system further comprises a fourth vertically-disposed structural member adapted to be detachably connected slot-to-slot to one of the at least one slot in the circular support structures.

4. The modular assembly system of claim 1 wherein the system comprises a plurality of circular support structures.

* * * * *